US009475606B2

(12) United States Patent
Ball et al.

(10) Patent No.: US 9,475,606 B2
(45) Date of Patent: Oct. 25, 2016

(54) CARTON AND CARTON BLANK

(71) Applicant: MeadWestvaco Packaging Systems, LLC, Richmond, VA (US)

(72) Inventors: Nathaniel B. Ball, Richmond, VA (US); Andrew T. Peeler, Henrico, VA (US); Bradford J. Walling, Chesterfield, VA (US); Matthew E. Zacherle, Chesterfield, VA (US); Caleb S. Loftin, Richmond, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 14/400,170

(22) PCT Filed: May 15, 2013

(86) PCT No.: PCT/US2013/041119

§ 371 (c)(1),
(2) Date: Nov. 10, 2014

(87) PCT Pub. No.: WO2013/173444

PCT Pub. Date: Nov. 21, 2013

(65) Prior Publication Data

US 2015/0122877 A1 May 7, 2015

Related U.S. Application Data

(60) Provisional application No. 61/647,482, filed on May 15, 2012, provisional application No. 61/670,007, filed on Jul. 10, 2012, provisional application No. 61/810,842, filed on Apr. 11, 2013.

(51) Int. Cl.
*B65D 5/462* (2006.01)
*B65D 5/54* (2006.01)

(Continued)

(52) U.S. Cl.
CPC ..... *B65D 5/541* (2013.01); *B65D 5/0281* (2013.01); *B65D 5/46192* (2013.01); *B65D 5/54* (2013.01); *B65D 5/542* (2013.01)

(58) Field of Classification Search
CPC .. B65D 5/0281; B65D 5/46192; B65D 5/54; B65D 5/541; B65D 5/542; B65D 71/36
USPC ..... 229/117.13, 117.14, 117.16, 241; 206/427
See application file for complete search history.

(56) References Cited

U.S. PATENT DOCUMENTS 3,263,900 A * 8/1966 Link ..... B65D 5/542 229/120.09
4,905,837 A 3/1990 Schuster (Continued)

FOREIGN PATENT DOCUMENTS

GB 1265263 2/1970
WO WO 97/21607 6/1997

OTHER PUBLICATIONS

International Search Report for PCTUS13041119 dated Sep. 9, 2013.

*Primary Examiner* — Gary Elkins
(74) *Attorney, Agent, or Firm* — WestRock Intellectual Property Group

(57) ABSTRACT

A carton (90) for packaging one of more articles includes a first panel (22*a*, 26*a*, 128*a*, 226*a*) and a second panel (24*a*, 28*a*, 124*a*, 222*a*). The first panel (22*a*, 26*a*, 128*a*, 226*a*) is in at least partially overlapping relationship with the second panel (24*a*, 28*a*, 124*a*, 222*a*) to define an overlapping region. The carton (90) includes a weakened line of severance (30*a*, 30*b*, 34*a*, 34*b*, 49*a*, 49*b*, 69*a*, 69*b*, 129*a*, 129*b*, 229*a*, 229*b*) which extends from the first panel across the overlapping region and into the second panel to be contiguous. The first panel includes a recess (R) defined at least in part in the overlapping region and extending at least partially across a portion of the first panel in the overlapping region. The recess (R) is arranged in registry with at least a portion of the weakened line of severance in the second panel.

19 Claims, 14 Drawing Sheets

(51) Int. Cl.

| | |
|---|---|
| ***B65D 71/36*** | (2006.01) |
| ***B65D 5/46*** | (2006.01) |
| ***B65D 5/02*** | (2006.01) |

(56) References Cited

U.S. PATENT DOCUMENTS

| | | | | |
|---|---|---|---|---|
| 7,073,665 | B2 * | 7/2006 | Auclair | B65D 71/36 206/427 |
| 7,328,798 | B2 * | 2/2008 | Auclair | B65D 71/36 206/427 |
| 7,743,968 | B2 | 6/2010 | Theelen | |
| 8,479,973 | B2 * | 7/2013 | Brand | B65D 71/36 229/117.13 |
| 2003/0080180 | A1 | 5/2003 | Holley | |
| 2006/0006216 | A1 * | 1/2006 | Moll | B65D 5/5445 229/235 |
| 2013/0181042 | A1 * | 7/2013 | Conradi | B65D 5/00 229/117.16 |

* cited by examiner

CARTON AND CARTON BLANK

CROSS REFERENCE TO RELATED APPLICATIONS

This application claims the benefit of U.S. Provisional Patent Applications Nos. 61/647,482; 61/670,007; and 61/810,842 filed May 15, 2012; Jul. 10, 2012; and Apr. 11, 2013 respectively, which are incorporated herein by reference in their entireties.

FIELD OF THE INVENTION

The present invention relates to a carton and to a blank for forming a carton more specifically, but not exclusively, to a carton having a tear mechanism for facilitating tear of at least one panel of the carton.

BACKGROUND OF THE INVENTION

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide multi-packs with features such as, but not limited to, handles and/or dispensers or access means. These features often require a portion of the carton to be torn or separated from another portion of the carton; this may require tearing or separating two or more overlapping layers of the material from which the carton is made. The present invention provides a tear mechanism which facilitates tearing of such overlapping layers.

The present invention seeks to overcome or at least mitigate the problems of the prior art.

SUMMARY OF INVENTION

According to a first aspect of the present invention there is provided a carton for packaging one or more articles, the carton comprising a first panel and a second panel, the first panel being disposed in at least partially overlapping relationship with the second panel to define an overlapping region, the carton comprising a weakened line of severance which extends from the first panel across the overlapping region and into the second panel in a contiguous manner, wherein the first panel comprises a recess or notch defined at least in part in the overlapping region, the recess being arranged in registry with at least a portion of the weakened line of severance in the second panel. Optionally, the recess or notch extends at least partially across a portion of the first panel which is within the overlapping region.

Optionally, the at least a portion of the weakened line of severance in the second panel is located within the overlapping region.

Optionally, the weakened line of severance defined in the first panel intersects the recess or terminates at the recess.

Optionally, the weakened line of severance defines part of a handle structure.

Additionally or alternatively, the weakened line of severance defines part of an access device for removing an article from the carton.

Optionally, the recess is aligned, in the direction of the thickness of the first and second panels, with the at least a portion of the weakened line of severance in the second panel.

According to a second aspect of the present invention there is provided a carton for packaging one or more articles, the carton comprising a plurality of walls including a top wall, a first side wall, a second side wall, a first end wall, a second end wall and a bottom wall, one of the plurality of walls comprises a first panel and a second panel, the first panel being disposed in at least partially overlapping relationship with the second panel to define an overlapping region, the one of the plurality of walls further comprising a weakened line of severance which extends from the first panel across the overlapping region and into the second panel in a contiguous manner, wherein the first panel comprises a recess or notch defined at least in part in the overlapping region and extending at least partially across a portion of the first panel within the overlapping region, the recess or notch being arranged in registry with at least a portion of the weakened line of severance in the second panel.

In some embodiments, the top wall, first side wall, second side wall and bottom wall may form a tubular structure having opposed ends which are at least partially closed by the first and second end walls respectively. The one of the plurality of walls may comprise the first end wall, and the first end wall may comprise a first end closure panel and a second end closure panel. The first and second end closure panels may comprise the first and second panels respectively, and the recess or notch may be struck from the first end closure panel and may overlie the at least a portion of the weakened line of severance in the second end wall.

The recess or notch may extend from a free end edge of the first end closure panel and the portion of the first end closure panel that the recess or notch extends across may have a width that is less than a half of the width of the first end closure panel. The width of the first end closure panel may be defined as the distance between its free end edge and a hinged connection between the first end closure panel and an adjacent one of said plurality of walls.

Optionally, the first end closure panel further comprises a second recess, the first recess or notch extending from a first free end edge of the first end closure panel and the second recess extending from a second free end edge of the first end closure panel wherein the first free edge is positioned opposite to the second free end edge.

The recess or notch may be aligned, in the direction of the thickness of the first and second panels, with the at least a portion of the weakened line of severance in the second panel.

The at least a portion of the weakened line of severance in the second panel may be located within the overlapping region.

Optionally, the carton may have a handle structure defined in part in the first panel of the one of the plurality of walls and in part in the second panel of the one of the plurality of walls, and the weakened line of severance may define at least part of the handle structure.

According to a third aspect of the present invention there is provided a carton for packaging one or more articles comprising a plurality of walls including a top wall, a first side wall, a second side wall, a first end wall, a second end wall and a bottom wall, the carton having a removable portion for accessing said one or more articles, the removable portion defined in part in a first panel of one of the plurality of walls and in part in a second panel of the one of the plurality of walls, the first panel being disposed in at least partially overlapping relationship with the second panel to define an overlapping region, the removable portion comprising a weakened line of severance which extends from the first panel across the overlapping region and into the second panel in a contiguous manner, wherein the first panel comprises a recess or notch defined at least in part in the overlapping region and extending at least partially across the overlapping region, the recess or notch being arranged in registry with at least a portion of the weakened line of severance in the second panel.

In some embodiments, the top wall, first side wall, second side wall and bottom wall form a tubular structure having opposed ends which are at least partially closed by the first and second end walls respectively, the one of the plurality of walls comprising the first end wall, the first end wall comprising a first end closure panel and a second end closure panel, the first and second end closure panels comprise the first and second panels respectively, the recess or notch is struck from the first end closure panel of the first end wall and overlies the at least a portion of the weakened line of severance in the second end closure panel. According to a fourth aspect of the present invention there is provided a blank for forming a carton, the blank comprising a first panel and a second panel, the first panel being arranged so as to be disposable in at least partially overlapping relationship with the second panel in a set-up carton to define an overlapping region, the carton comprising a weakened line of severance defined in the first panel and the second panel, the weakened line of severance configured to be contiguous in a set-up carton such that the weakened line of severance extends from the first panel across the overlapping region and into the second panel in a contiguous manner, wherein the first panel comprises a recess or notch defined at least in part in the overlapping region and extending at least partially across a portion of the first panel in the overlapping region and wherein the recess or notch is arranged in registry with at least a portion of the weakened line of severance in the second panel.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Figure 1:
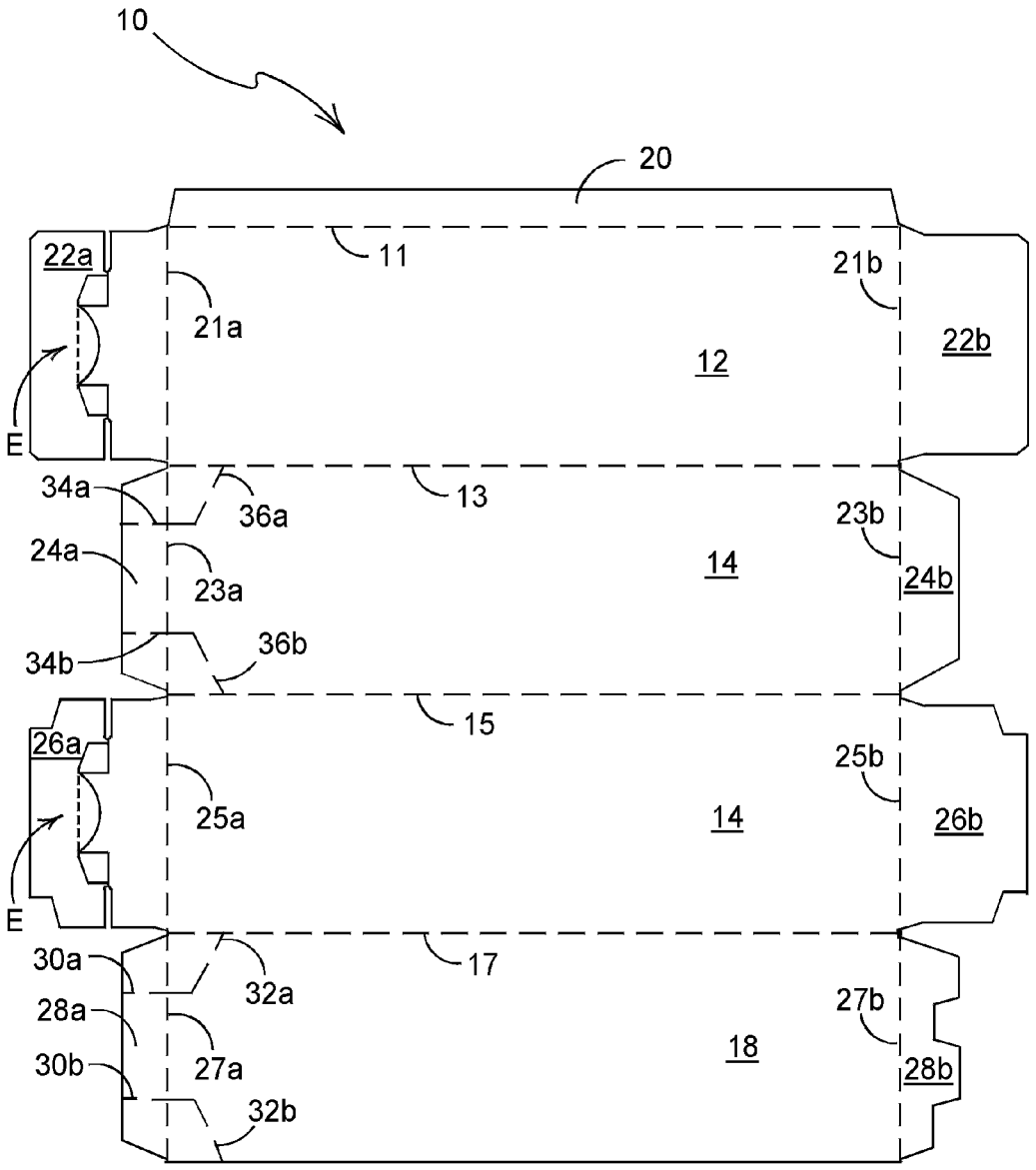
FIG. 1 is a plan view from above of a blank for forming a carton according to a first embodiment of the disclosure.

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

The present disclosure relates to a tear mechanism for facilitating the tearing of two adjoined panels of a carton formed from a blank of foldable material. The tear mechanism has particular benefit in the field of packaging and it will be recognised by those skilled in the art that tear mechanisms are employed variously in packaging in the formation of, for example, opening features, dispensing features, end-pull devices, carrying features including handles, gripping features and the like. In such applications a first panel and a second panel of a carton or packaging arrangement are often at least partially overlaid and affixed together. The present disclosure provides a tear mechanism which facilitates the controlled breaking of a tear or frangible line formed in an overlapping region defined by the overlaid first and second panels. The mechanism of the invention comprises a cutline, a frangible line, a tear line or some form of weakened line of severance in both the first panel and the second panel. The cutline, frangible line, tear line or some form of weakened line of severance is configured to be contiguous as it crosses the overlapping region of the first and second panels. The tear mechanism of the disclosure provides a recess that is defined in and which extends across a portion of the first panel that is in overlapping relationship with the second panel. The recess is arranged in registry with a portion of the cutline or weakened line of severance which extends across the second panel and in this way, the necessity to tear through two plies of material simultaneously is avoided. In this way the tear mechanism makes it easier for a user of the package to break the weakened line of severance or to partially separate the first and second panels in order to activate or deploy a feature of the package. In the following description three illustrated applications of tear mechanisms of the disclosure are provided; it will be recognised that the tear mechanism may be implemented in other beneficial packaging applications.

Referring to FIG. 1 there is shown a plan view of a blank 10 capable of forming a carton 90 for packaging one or more primary products containers, such as, but not limited to, bottles or cans, hereinafter referred to as articles.

In the embodiments detailed herein, the terms 'carton' and 'carrier' refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blank 10 is configured to form a carton 90 or carrier for packaging an exemplary arrangement of exemplary articles. In a first illustrated exemplary embodiment, the arrangement is a 2×6 matrix or array and the articles are cans. The blank 10 can be alternatively configured to form a carrier 90 for packaging other types, number and size of article and/or for packaging articles in a different arrangement or configuration.

The blank 10 comprises a plurality of main panels 12, 14, 16, 18 forming: a bottom panel 12, a first side panel 14, a top panel 16 and a second side panel 18 in a set-up carton 90. A glue panel 20 is hinged to the bottom panel 12 along a fold line 11. The bottom panel 12 is hinged to the first side panel 14 by a fold line 13. The first side panel 14 is hinged to the top panel 16 by a fold line 15. The top panel 16 is hinged to the second side panel 18 by a fold line 17.

The plurality of main panels 12, 14, 16, 18 form a tubular structure in a set-up condition. Each of the ends of the tubular structure are at least partially closed by end closure panels 22*a*, 24*a*, 26*a*, 28*a*, 22*b*, 24*b*, 26*b*, 28*b*. End closure panels 22*a*, 24*a*, 26*a*, 28*a* are configured to close a first end of the tubular structure and end panels 22*b*, 24*b*, 26*b*, 28*b* are configured to close a second end of the tubular structure. A first end closure panel 22*a* is hinged to a first end of bottom panel 12 by a fold line 21*a*. A second end closure panel 24*a* is hinged to a first end of first side panel 14 by a fold line 23*a*. A third end closure panel 26*a* is hinged to a first end of top panel 16 by a fold line 25*a*. A fourth end closure panel 28*a* is hinged to a first end of the second side panel 18 by a fold line 27*a*.

A fifth end closure panel 22*b* is hinged to a second end of bottom panel 12 by a fold line 21*b*. A sixth end closure panel 24*b* is hinged to a second end of first side panel 14 by a fold line 23*b*. A seventh end closure panel 26*b* is hinged to a second end of top panel 16 by a fold line 25*b*. An eighth end closure panel 28*b* is hinged to a second end of the second side panel 18 by a fold line 27*b*.

A handle structure or end-pull device E is provided in the first and third end closure panels 22*a*, 26*a*. The second and fourth end closure panels 24*a*, 28*a* comprise tear lines or weakened lines of severance 34*a*, 34*b*, 30*a*, 30*b*. The weakened lines of severance 34*a*, 34*b*, 30*a*, 30*b* cooperate with the end-pull device E provided in the first and third end closure panels 22*a*, 26*a*. Second end closure panel 24*a* comprises a first weakened line of severance 34*a* and a second weakened line of severance 34*b*. The first and second weakened lines of severance 34*a*, 34*b* extend across the second end closure panel 24*a* and into the first side panel 14 to which the second end closure panel 24*a* is hinged. Preferably, the first and second weakened lines of severance 34*a*, 34*b* are arranged to be substantially parallel to the fold lines 13, 15; in other words, substantially perpendicular to the fold line 23*a*.

A first fold line 36*a* is provided in the first side panel 14. The first fold line 36*a* extends from an end of the first weakened line 34*a* disposed in first side panel 14 to the fold line 13 between the bottom panel 12 and the first side panel 14. Preferably, first fold line 36*a* is arranged so as to be convergent with respect to the fold line 23*a*, the first fold line 36*a* being arranged so as to be in closer proximity to fold line 23*a* at an end adjacent to the first weakened line 34*a* than at an end adjacent to the fold line 13.

A second fold line 36*b* is provided in the first side panel 14. The second fold line 36*b* extends from an end of the second weakened line 34*b* that is disposed in the first side panel 14 to the fold line 15 between the top panel 16 and the first side panel 14. Preferably, the second fold line 36*b* is arranged so as to be convergent with respect to the fold line 23*a*, the second fold line 36*b* being arranged so as to be in closer proximity to fold line 23*a* at an end adjacent to the second weakened line 34*b* than at an end adjacent to the fold line 15.

Fourth end closure panel 28*a* comprises a third weakened line of severance 30*a* and a fourth weakened line of severance 30*b*. The third and fourth weakened lines of severance 30*a*, 30*b* extend across the fourth end closure panel 28*a* and into the second side panel 18 to which the second end closure panel 28*a* is hinged. Preferably, the third and fourth weakened lines of severance 30*a*, 30*b* are arranged to be substantially parallel to the fold line 17; in other words, substantially perpendicular to the fold line 27*a*.

A third fold line 32*a* is provided in the second side panel 18. The third fold line 32*a* extends from an end of the third weakened line 30*a* that is disposed in the second side panel 18 to the fold line 17 between the top panel 16 and the second side panel 18. Preferably, third fold line 32*a* is arranged so as to be convergent with respect to the fold line 27*a* and is arranged so as to be in closer proximity to fold line 27*a* at an end adjacent to the third weakened line 30*a* than at an end adjacent to the fold line 17.

A fourth fold line 32*b* is provided in the second side panel 18. The fourth fold line 32*b* extends from an end of the fourth weakened line 30*b* that is disposed in the second side panel 18 to the free side edge of the second side panel 18. Preferably, the fourth fold line 32*b* is arranged so as to be convergent with respect to the fold line 27*a* and is arranged so as to be in closer proximity to fold line 27*a* at an end adjacent to the fourth weakened line 30*b* than at an end adjacent to the free side edge of the second side panel 18.

Figure 2:
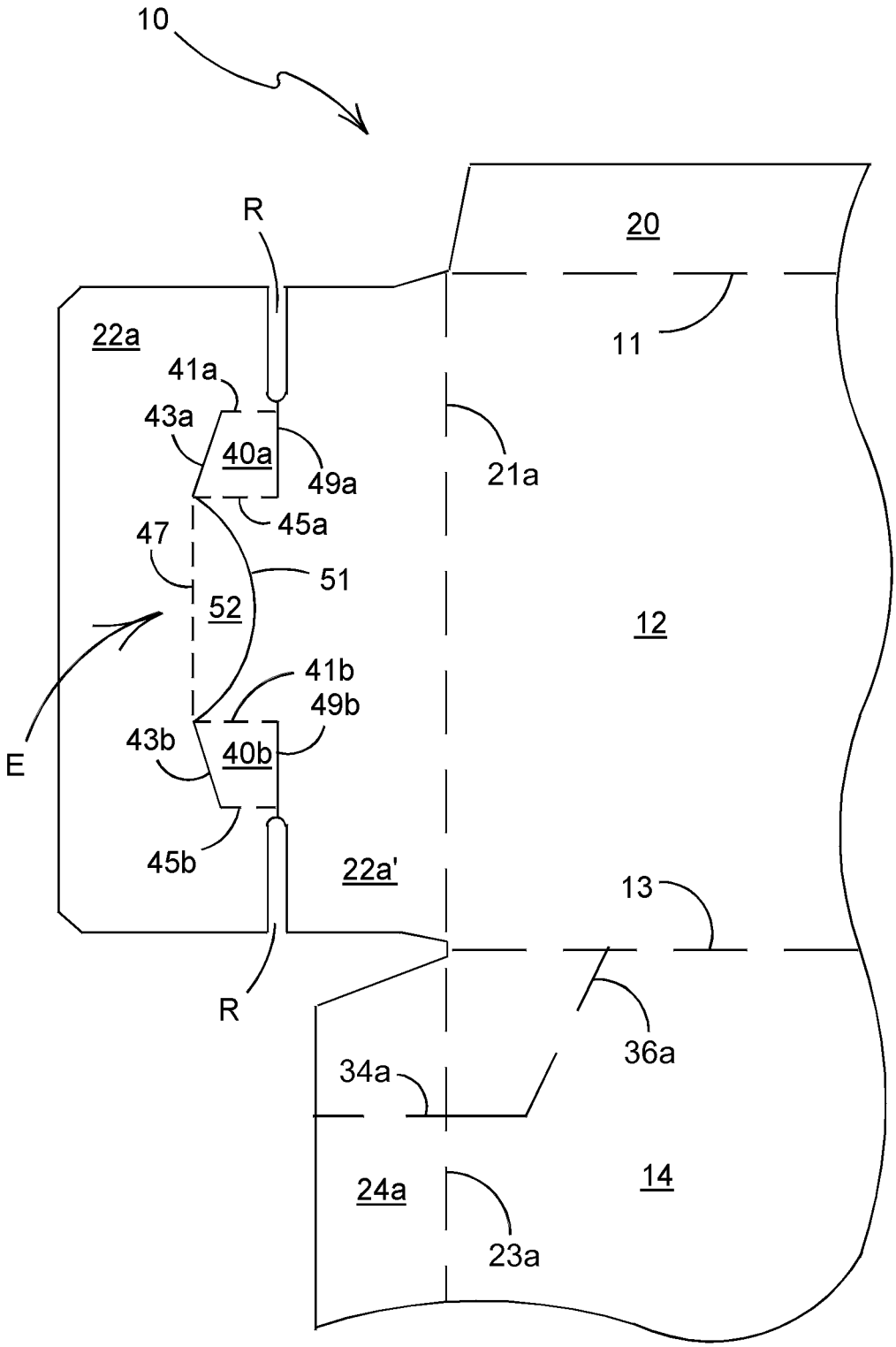
FIG. 2 is an enlarged plan view from above of a first portion of the blank of FIG. 1.

FIG. 2 illustrates an enlarged view of the first end closure panel 22*a*. The first end closure panel 22*a* comprises a first part of an end-pull device E. The first part of the end-pull device E extends transversely across the first end closure panel 22*a*. The first part of the end-pull device E comprises a handle flap 52 defined in part by a first transversely orientated fold line 47 and in part by a first weakened line of severance 51. First transversely orientated fold line 47 is substantially parallel to fold line 21*a* (between the first end closure panel 22*a* and the bottom panel 12). Preferably, the first weakened line of severance 51 is substantially arcuate in shape and more preferably is substantially hemispherical in shape. The first weakened line of severance 51 commences at a first end of the first transversely orientated fold line 47 and terminates at a second end of the first transversely orientated fold line 47.

Figure 3:
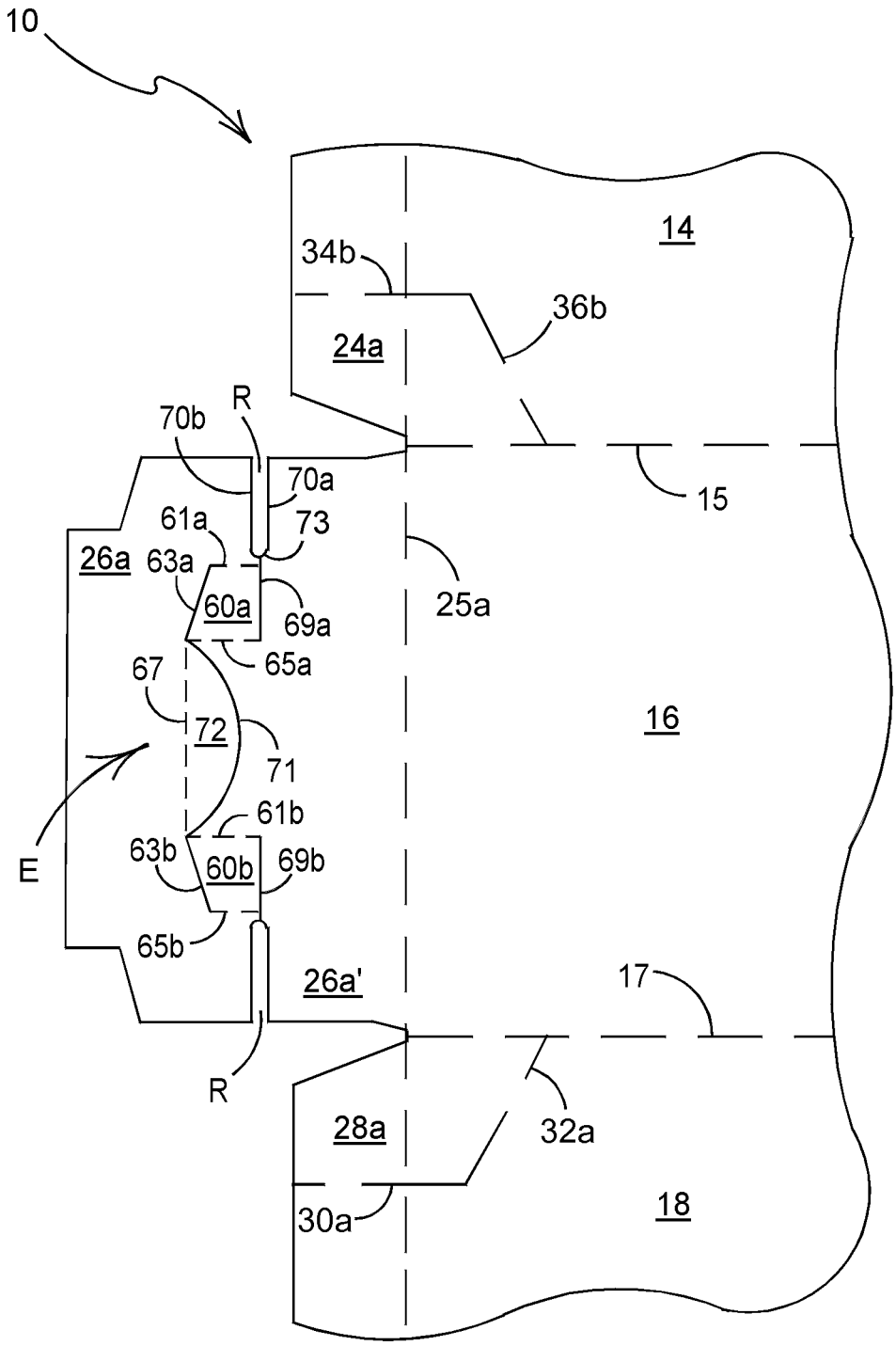
FIG. 3 is an enlarged plan view from above of a second portion of the blank of FIG. 1.

A first web panel 40*a* is provided at the first end of first transversely orientated fold line 47 and a second web panel 40*b* is provided at the second end of first transversely orientated fold line 47. The first web panel 40*a* is defined in part by first cut line 43*a*; in part by a second cut line 49*a*; in part by a first fold line 41*a*; and in part by a second fold line 45*a*. The first cut line 43*a* extends from first transversely orientated fold line 47 and is disposed at an angle relative thereto. The angle may be between about 3° and about 15°. The second fold line 45*a* extends from the intersection of the first transversely orientated fold line 47 and the cut line 43*a* and the second fold line 45*a* is disposed perpendicularly to the first transversely orientated fold line 47. First fold line 41*a* extends from an end of cut line 43*a* opposite to the end at which cut line 43*a* meets first transversely orientated fold line 47. The first fold line 41*a* is parallel to the second fold line 45*a*. The second cut line 49*a* extends between the first fold line 41*a* and the second fold line 45*a* and is disposed perpendicularly to the first and second fold lines 41*a*, 45*a*. The second cut line 49*a* extends from the end of the second fold line 45*a* that is opposite to the end which meets the first cut line 43*a*. The second cut line 49*a* extends to and beyond an end of the first fold line 41*a* that is opposite to the end which meets the first cut line 43*a*. The second cut line 49*a* extends beyond the termination of the first fold line 41*a* to meet or intersect with a deep and/or elongated recess (or notch) R cut from a first side edge of the first end closure panel 22*a*. This may prevent the second cut line 49*a* undesirably and uncontrollably propagating further into the first end closure panel 22*a*. The recess or notch R is shown in FIG. 3, wherein it can be seen that the recess or notch is optionally defined by two at least substantially parallel cut sides 70*a*, 70*b* which converge and terminate in an arcuate cut portion 73 (also referred to as termination 73). The recess R is optionally elongate, such that the length of side cuts 70*a*, 70*b* is greater than the distance between the cut sides. Preferably, but nevertheless optionally, the length of the side cuts 70*a*, 70*b* may be between about 4 and 10 times greater than the distance between the side cuts 70*a*, 70*b*. The recess may be about 4 cm to about 6 cm long and about 0.3 cm to about 1 cm wide.

The second web panel 40*b* is formed at the opposite end of the handle flap 52 to the first web panel 40*a* and is similarly formed and shaped such that the first part of the end-pull device E is symmetrical. The second web panel 40*b* is defined in part by third cut line 43*b*; in part by a fourth cut line 49*b*; in part by a third fold line 41*b*; and in part by a fourth fold line 45*b*.

The third cut line 43*b* extends from the first transversely orientated fold line 47 and is disposed at an angle relative thereto. The third fold line 41*b* extends from the intersection of the first transversely orientated fold line 47 and the cut line 43*b*. The third fold line 41*b* is disposed perpendicularly to first transversely orientated fold line 47. The fourth fold line 45*b* extends from the end of the third cut line 43*b* that is opposite to the end at which third cut line 43*b* meets the first transversely orientated fold line 47. The fourth fold line 45*b* is parallel to the third fold line 41*b*. The fourth cut line 49*b* extends between the third fold line 41*b* and the fourth fold line 45*b* and is disposed perpendicularly to the third and fourth fold lines 41*b*, 45*b*.

Fourth cut line 49*b* extends from the end of third fold line 41*b* that is opposite to the end which meets the third cut line 43*b*. The fourth cut line 49*b* extends to and beyond an end of the fourth fold line 45*b* that is opposite to the end which meets the third cut line 43*b*. The fourth cut line 49*b* extends beyond the fourth fold line 45*b* to meet or intersect with a recess R cut from a second side edge of the first end closure panel 22*a*. This may prevent the fourth cut line 49*b* undesirably and uncontrollably propagating further into the first end closure panel 22*a*. This recess R is also shown in FIG. 3 and is optionally shaped, sized and proportioned similarly to and symmetrically with the recess R described above. In other embodiments where more than one recess R is provided, each recess R may be sized and/or shaped and/or proportioned differently to one or more of the other recesses R.

The first end closure panel 22*a* is divided into two parts by the recesses R, by the first and second web panels 40*a*, 40*b* and by the handle flap 52. The first end closure panel 22*a* is split into: a first lower part 22*a*'; and a first upper part 22*a*. First lower part 22*a*' forms part of a handle or grip portion of the end-pull device E.

FIG. 3 illustrates an enlarged view of the second end closure panel 26*a*. The second end closure panel 26*a* comprises a second part of the end-pull device E. The second part of the end-pull device E extends transversely across the first end closure panel 26*a* and is formed in a similar manner to the first part of the end-pull device E. The first part of the end-pull device E comprises a second handle flap 72 defined in part by a second transversely orientated fold line 67 and in part by a second weakened line of severance 71. Second transversely orientated fold line 67 is substantially parallel to fold line 25*a*. Preferably, the second weakened line of severance 71 is substantially arcuate in shape and more preferably is substantially hemispherical in shape. The second weakened line of severance 71 commences at a first end of the second transversely orientated fold line 67 and terminates at a second end of the second transversely orientated fold line 67.

A third web panel 60*a* is provided at the first end of the second transversely orientated fold line 67 and a fourth web panel 60*b* is provided at the second end of the second transversely orientated fold line 67. The third web panel 60*a* is defined in part by fifth cut line 63*a*; in part by a sixth cut line 69*a*; in part by a fifth fold line 61*a*; and in part by a sixth fold line 65*a*. The fifth cut line 63*a* extends from the second transversely orientated fold line 67 and is disposed at an angle relative thereto. The angle may be between about 3° and about 15°. The sixth fold line 65*a* extends from the intersection of the second transversely orientated fold line 67 and the fifth cut line 63*a*. The sixth fold line 65*a* is perpendicular to the second transversely orientated fold line 67. The fifth fold line 61*a* extends from the end of the fifth cut line 63*a* that is opposite to the end at which the fifth cut line 63*a* meets the second transversely orientated fold line 67. The fifth fold line 61*a* is parallel to the sixth fold line 65*a*. Sixth cut line 69*a* extends between the fifth fold line 61*a* and the sixth fold line 65*a* and is perpendicular to the fifth and sixth fold lines 61*a*, 65*a*. The sixth cut line 69*a* extends from the end of the sixth fold line 65*a* that is opposite to the end which meets the fifth cut line 63*a*. The sixth cut line 69*a* extends to and beyond the end of the fifth fold line 61*a* that is opposite to the end which meets the fifth cut line 63*a*. The sixth cut line 69*a* extends beyond the fifth fold line 61*a* to meet, intersect or terminate at a termination 73 of a further recess R, which recess R is cut from a first side edge of the second end closure panel 26*a*. The further recess R is formed similarly to the previously described recesses R.

The fourth web panel 60*b* is defined in part by seventh cut line 63*b*; in part by an eighth cut line 69*b*; in part by a seventh fold line 61*b*; and in part by an eighth fold line 65*b*.

The seventh cut line 63*b* extends from the second transversely orientated fold line 67 and is disposed at an angle relative thereto. The angle may be between about 3° and about 15°. The seventh fold line 61*b* extends from the intersection of the second transversely orientated fold line 67 and the seventh cut line 63*b*. The seventh fold line 61*b* is perpendicular to the second transversely orientated fold line 67. The eighth fold line 65*b* extends from an end of seventh cut line 63*b* that is opposite to the end at which the seventh cut line 63*b* meets the second transversely orientated fold line 67. The eighth fold line 65*b* is parallel to the seventh fold line 61*b*. Eighth cut line 69*b* extends between the seventh fold line 61*b* and the eighth fold line 65*b* and is perpendicular to the seventh and eighth fold lines 61*b*, 65*b*. Eighth cut line 69*b* extends from the end of seventh fold line 61*b* that is opposite to the end which meets the seventh cut line 63*b*. Eighth cut line 69*b* extends to and beyond the end of eighth fold line 65*b* that is opposite to the end which meets the seventh cut line 63*b*. The eighth cut line 69*b* extends beyond the eighth fold line 65*b* to meet, intersect or terminate at a recess R that is cut from a second side edge of the second end closure panel 26*a*. The recess R also comprises spaced and parallel side cuts that are adjoined at one end by a curved termination. In other envisaged embodiments, the recess R may comprise a straight or other shaped termination.

In a similar manner to the first end closure panel 22*a*, the second end closure panel 26*a* is divided into two parts by the recesses R, by the third and fourth web panels 60*a*, 60*b* and by the second handle flap 72. The second end closure panel 26*a* is split into: a second upper part 26*a*' and a second lower part 26*a*. The second lower part 26*a* forms part of a handle or grip portion of the end-pull device E.

Figure 4:
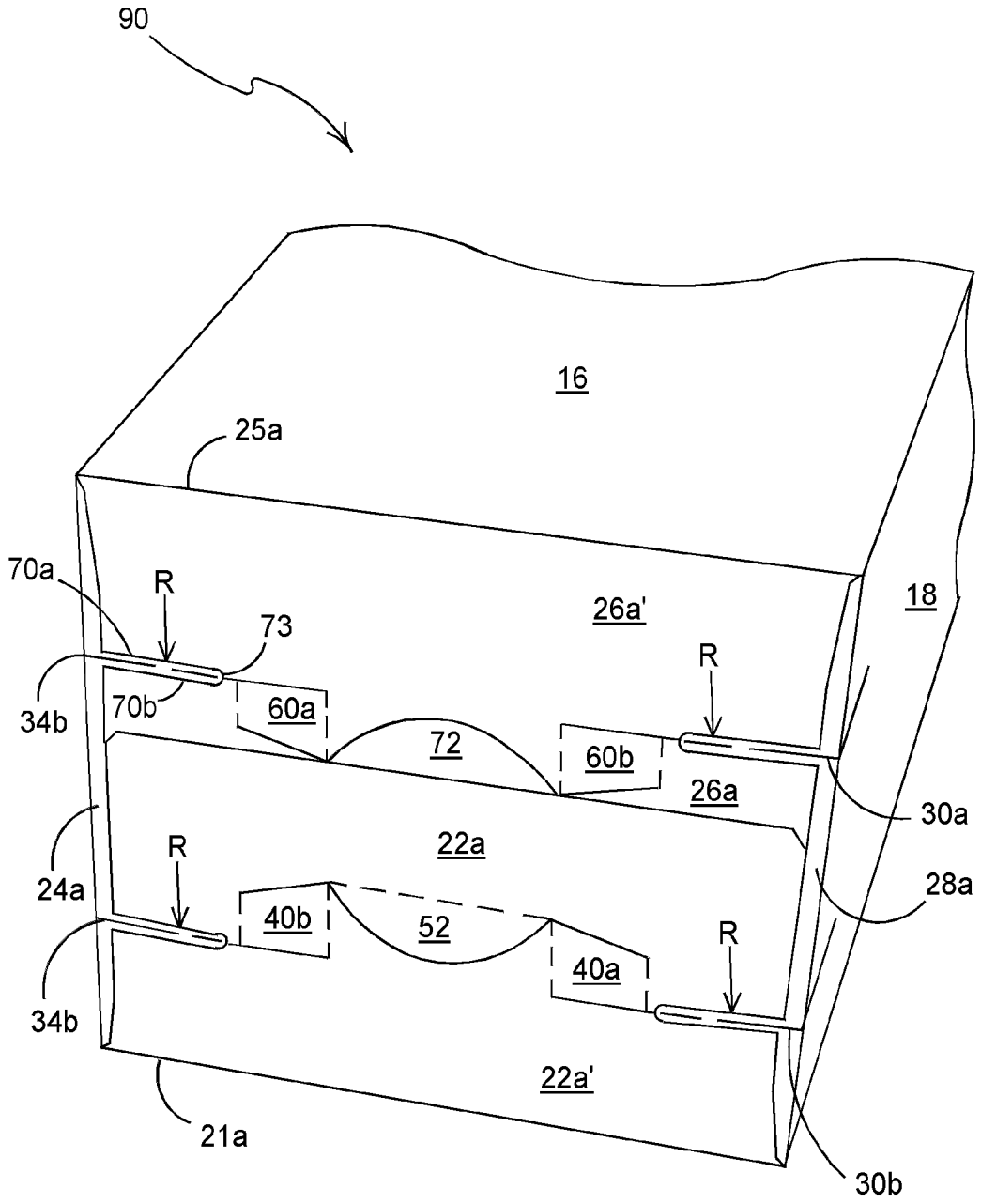
FIG. 4 is a perspective view from above of an end portion of a carton formed from the blank of FIG. 1 showing a handle structure in a stowed state.
Figure 5:
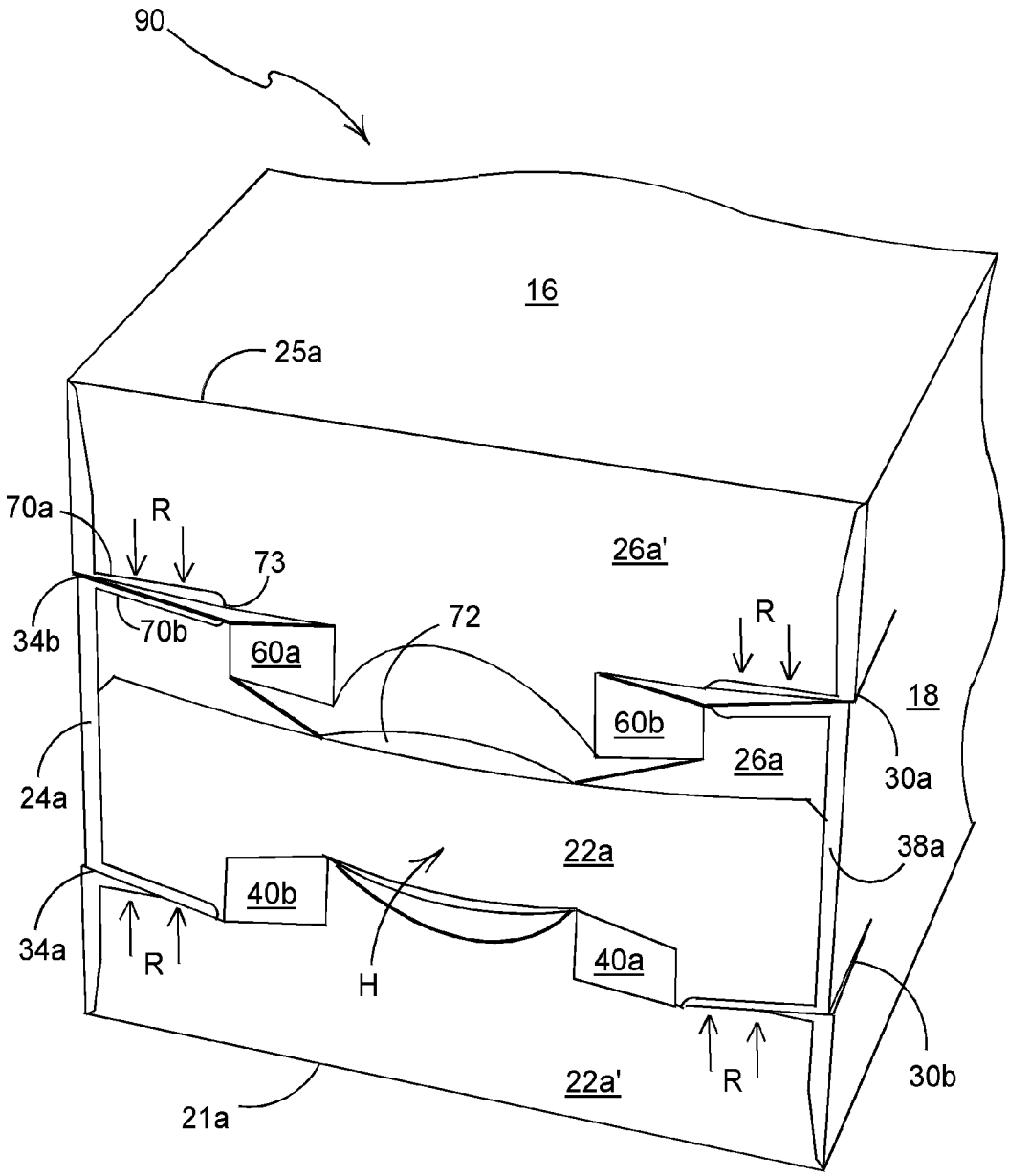
FIG. 5 is a perspective view from above of an end portion of a carton formed from the blank of FIG. 1 showing a handle structure in a deployed state.

Turning to the construction of the carton 90 as illustrated in FIGS. 4 and 5 it is envisaged that the carton 90 can be formed by a series of sequential folding operations in a straight line machine so that the carton 90 is not required to be rotated or inverted to complete its construction. The folding process is not limited to that described below and may be altered according to particular manufacturing requirements.

The carton 90 is formed by folding the glue panel 20 about the fold line 11 to overlie the bottom panel 12. The top panel 16 and the second side panel 18 are folded about the fold line 15 such that the top panel 16 overlies the first side panel 14 and the second side panel 18 overlies the glue panel 20 and the bottom panel 12. Glue or other adhesive treatment is applied to the glue panel 20 and/or to a corresponding area of the second side panel 18. The second side panel 18 is secured to the glue panel 20, to form a flat collapsed tubular structure. This flat collapsed tubular structure can be shipped or transported to a converter plant. At the converter plant the flat collapsed tubular structure is opened and erected to form a tubular structure having a substantially square or rectangular cross-sectional shape.

The erected tubular structure is loaded with articles through one or both open ends. One or more of the end closure panels 22*a*, 24*a*, 26*a*, 28*a*, 22*b*, 24*b*, 26*b*, 28*b* may be folded outwardly to act as funnel to facilitate insertion of the articles into the carton 90.

Once the articles are loaded into the tubular structure the ends of the tubular structure are closed. A first end of the tubular structure is closed by folding the second end closure panel 24*a* about fold line 23*a* and folding fourth end closure panel 28*a* about fold line 27*a*. Glue or other adhesive treatment is applied to an outer surface of the second and fourth end closure panels 24*a*, 28*a*. In alternative embodiments the glue or adhesive treatment is applied to an inner surface of corresponding region of the first and third end closure panels 22*a*, 26*a*. The third end closure panel 26*a* is then folded about the fold line 25*a* and is secured to the second and fourth end closure panels 24*a*, 28*a*. Glue or adhesive treatment is applied to an outer surface of the second lower part 26*a* of the third end closure panel 26*a* and/or to an inner surface of the first upper part 22*a* of the first end closure panel 22*a*. The first end closure panel 22*a* is folded about fold line 21*a* and brought into contact with the third end closure panel 26*a* such that the first upper part 22*a* of the first end closure panel 22*a* is in overlapping relationship with second lower part 26*a* of the third end closure panel 26*a* and is secured and affixed thereto.

A second end of the tubular structure is closed by folding the sixth end closure panel 24*b* about fold line 23*b* and folding eighth end closure panel 28*b* about fold line 27*b*. Glue or other adhesive treatment may be applied to an outer surface of the sixth and eighth end closure panels 24*b*, 28*b*. In alternative embodiments the glue or adhesive treatment is applied to an inner surface of corresponding region of the fifth and seventh end closure panels 22*b*, 26*b*. The seventh end closure panel 26*b* is folded about the fold line 25*b* and secured to the sixth and eighth end closure panels 24*b*, 28*b*. Glue or adhesive treatment is applied to an outer surface of the seventh end closure panel 26*b* or to an inner surface of the fifth end closure panel 22*b*. The fifth end closure panel 22*b* is folded about fold line 21*b* and brought into contact with the third end closure panel 26*b* such that a portion of the fifth end closure panel 22*b* is in overlapping relationship with a portion of the third end closure panel 26*b* and is secured thereto.

In some embodiments one end of the tubular structure may be closed before loading articles through a remaining open end of the tubular structure.

The assembled carton 90 is shown in FIGS. 4 and 5. Each of the recesses R in each of the first and third end closure panels 22*a*, 26*a* is arranged such that it is in registration with a portion of a respective one of the weakened lines of severance 34*a*, 34*b*, 30*a*, 30*b* that are defined in the second and fourth end closure panels 24*a*, 28*a* respectively. It is envisaged that each recess R is elongate in shape and is dimensioned such that it extends across a region of the first or third end closure panels 22*a*, 26*a* which is in overlapping relationship with a respective one of the second or fourth end closure panels 24*a*, 28*a*. Each recess R is optionally curved at a closed end 73 (the end whereat the cut lines 49*a*, 49*b*, 69*a*, 69*b* terminate). As such, each recess R has an elongated "U" shape and is longer than it is wide.

The end-pull device E can be employed to remove or slide the carton 90 from a shelf, and is particularly useful when the carton 90 is stacked in close proximity to other cartons 90 or the walls of a shelving system where access to anything other than the end wall 22*a*/24*a*/26*a*/28*a* of the carton 90 is restricted.

A user can engage the handle H to pull the carton 90 as shown in FIG. 5. The handle H is deflected or displaced out of the end closure panel 26*a*, 22*a*. The region of the second end closure panel 24*a* defined between the first weakened lines of severance 34*a* and the second weakened line of severance 34*b* is also displaced outwardly of the carton 90. The region of the fourth end closure panel 28*a* defined between the third weakened lines of severance 30*a* and the fourth weakened line of severance 30*b* is also displaced outwardly of the carton 90. These regions are secured to the handle H by glue or other adhesive treatment.

The handle H is arranged to be orientated perpendicularly to a tubular axis of the articles disposed within the carton 90. Preferably, the articles are substantially cylindrical in shape, at least in part; this provides voids in the corners or the carton 90 defined by the fold lines 23*a*, 27*a*. These voids allow ends of the handle H to be displaced inwardly of the carton 90 and this allows a central portion of the handle H to be displaced outwardly of the end of the carton 90. In doing so it may be necessary for the region of the second end closure panel 24*a* defined between the first weakened line of severance 34*a* and the second weakened line of severance 34*b* and the region of the fourth end closure panel 28*a* defined between the third weakened lines of severance 30*a* and the fourth weakened line of severance 30*b* to pass through or outwardly beyond the second upper part 26*a*' and the first lower part 22*a*' so as to be external thereto. By providing the recesses R in the first and third end closure panels 22*a*, 26*a* the user can easily sever the weakened lines of severance 34*a*, 34*b*, 30*a*, 30*b*. It is not necessary for the user to sever a weakened line of severance in each of the two layers of material simultaneously.

The recess R also provides an alignment tolerance when assembling the carton 90 since the weakened lines 34*a*, 34*b*, 30*a*, 30*b* are readily alignable with the recesses R and within the outline shape of the recessed R. The provision of the recesses R also reduces the likelihood of the first or third end closure panel 22*a*, 26*a* interfering with the second or fourth end closure panel 24*a*, 28*a* as it passes the first or third end closure panel 22*a*, 26*a* when the handle H is deployed.

Referring now to FIGS. 6 to 17B, alternative embodiments of the present invention are shown. In the alternative illustrated embodiments, like numerals have, where possible, been used to denote like parts, albeit with the addition of the prefix "100" or "200" and so on to indicate that these features belong to the second, third, fourth embodiment and so on respectively. The alternative embodiments share many common features with the first embodiment and therefore only the differences from the embodiment illustrated in FIGS. 1 to 5 will be described in any greater detail.

Figure 6:
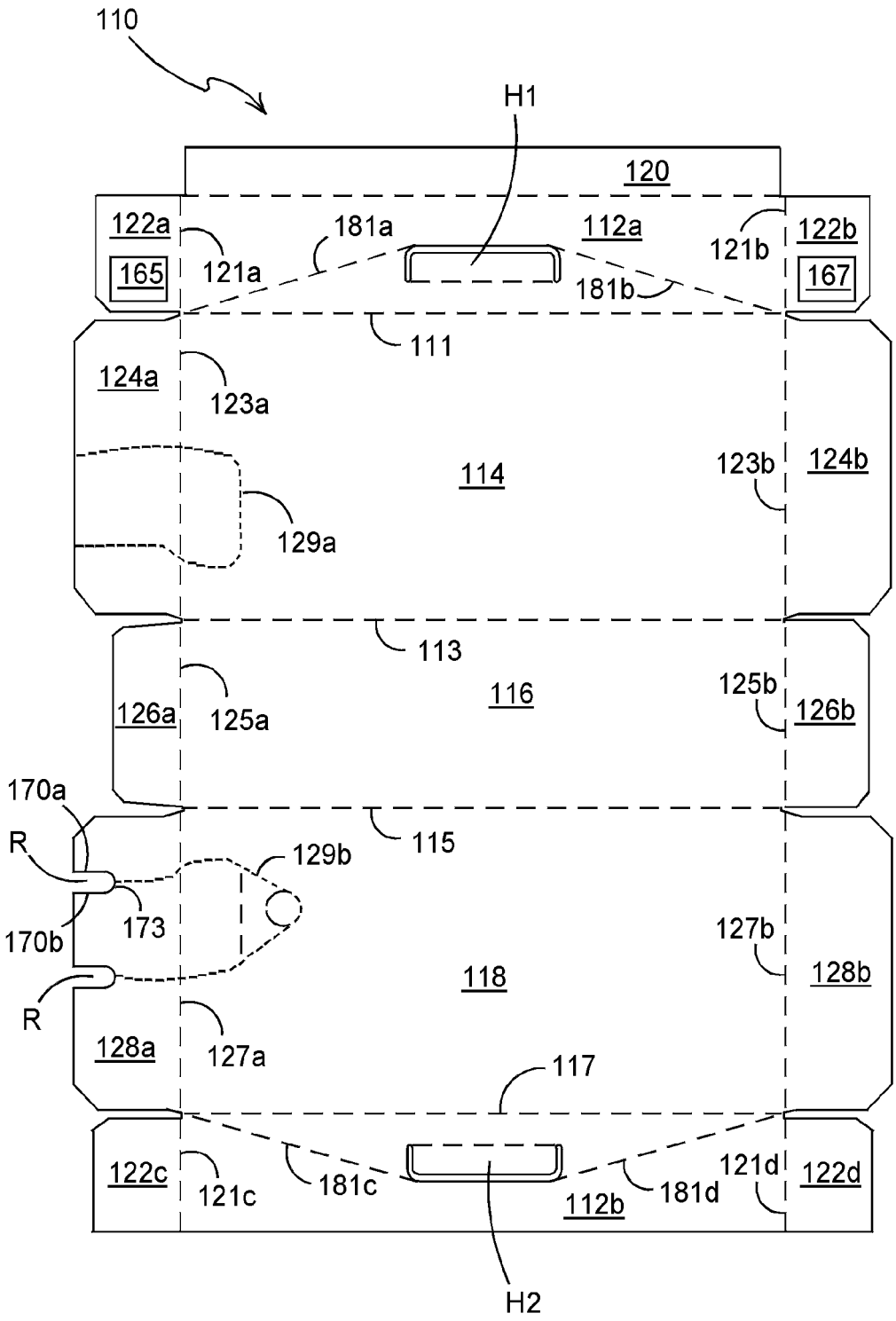
FIG. 6 is a plan view from above of a blank for forming a carton according to a second embodiment of the disclosure.

FIG. 6 illustrates a blank 110 for forming a carton (not shown). The blank 110 comprises a plurality of main panels 112*a*, 112*b*, 114, 116, 118 forming a set-up carton: a first top panel 112*a*, a first side panel 114, a bottom panel 116, a second side panel 118 and a second top panel 112*b*. A glue panel 120 is provided along a side edge of the first top panel 112*a*. The first top panel 112*a* is hinged to the first side panel 114 by a fold line 111. The first side panel 114 is hinged to the bottom panel 116 by a fold line 113. The bottom panel 116 is hinged to the second side panel 118 by a fold line 115. The second top panel 112*b* is hinged to the second side panel 118 by a fold line 117.

The plurality of main panels 112*a*, 112*b*, 114, 116, 118 form a tubular structure in a set-up condition, each of the ends of the tubular structure is at least partially closed by an end closure structure comprising end closure panels 122*a*, 122*c*, 124*a*, 126*a*, 128*a* and 122*b*, 122*d*, 124*b*, 126*b*, 128*b*. End closure panels 122*a*, 122*c*, 124*a*, 126*a*, 128*a* are configured to close a first end of the tubular structure and end panels 122*b*, 122*d*, 124*b*, 126*b*, 128*b* are configured to close a second end of the tubular structure. A first end closure panel 122*a* is hinged to the first end of the first top panel 112*a* by a fold line 121*a*. A second end closure panel 124*a* is hinged to a first end of the first side panel 114 by a fold line 123*a*. A third end closure panel 126*a* is hinged to a first end of the bottom panel 116 by a fold line 125*a*. A fourth end closure panel 128*a* is hinged to a first end of the second side panel 118 by a fold line 127*a*. A fifth end closure panel 122*c* is hinged to a first end of the second top panel 112*b* by a fold line 121*c*.

A sixth end closure panel 122*b* is hinged to a second end of the first top panel 112*a* by a fold line 121*b*. A seventh end closure panel 124*b* is hinged to a second end of the first side panel 114 by a fold line 123*b*. An eighth end closure panel 126*b* is hinged to a second end of the bottom panel 116 by a fold line 125*b*. A ninth end closure panel 128*b* is hinged to a second end of the second side panel 118 by a fold line 127*b*. A tenth end closure panel 122*d* is hinged to a second end of second top panel 112*b* by a fold line 121*d*.

In a set-up carton the first top panel 112*a* and the second top panel 112*b* form a composite top panel 112*a*/112*b*. The first and fifth end closure panels 122*a*, 122*c* form a first composite top end closure panel 122*a*/122*c*. The sixth and tenth end closure panels 122*b*, 122*d* form a second composite top end closure panel 122*b*/122*d*.

The first and sixth end closure panels 122*a*, 122*b* each comprise an optional aperture 165, 167 respectively.

The blank 110 comprises a first weakened line of severance 129*a* and a second weakened line of severance 129*b* which together form an access means or dispenser in a set-up carton for facilitating access to the articles being packaged. The first weakened line of severance 129*a* and the second weakened line of severance 129*b* together form a continuous or contiguous loop in a set-up carton.

The first weakened line of severance 129*a* is provided in part in the first side panel 114 and in part in the second end closure panel 124*a*. First weakened line of severance 129*a* commences from a free end edge of the second end closure panel 124*a* extends across the second end closure panel 124*a* into the first side panel 114. The first weakened line of severance 129*a* is substantially "U" shaped. The first weakened line of severance 129*a* returns into the second end closure panel 124*a* extends across the second end closure panel 124*a* and terminates at the free end edge of the second end closure panel 124*a* (at a location that is spaced from the location at which the first weakened line of severance 129*a* commences).

The second weakened line of severance 129*b* is provided in part in the second side panel 118 and in part in the fourth end closure panel 128*a*. Second weakened line of severance 129*b* commences from a first recess R, which interrupts a free end edge of the fourth end closure panel 128*a* and extends across the fourth end closure panel 128*a* into the second side panel 118. The recess or notch R is defined by side cuts 170*a*, 170*b* which are substantially parallel to one another and which are disposed substantially perpendicularly relative to an end edge of the fourth end closure panel 128*a*. The side cuts 170*a*, 170*b* converge at or are joined by an arcuate termination 173. The recess R is not as elongate as the recess R of the first embodiment and may only have a length that is between about 2 and 4 times the width (the distance between the side cuts 170*a* and 170*b*).

The second weakened line of severance 129*b* has a substantially "V" shaped portion in the second side panel 118. The second weakened line of severance 129*b* returns into the fourth end closure panel 128*a* extends across the fourth end closure panel 128*a* and terminates at a second recess R, which interrupts the free end edge of the fourth end closure panel 128*a*. The second recess or notch R is optionally identical in shape and size and proportion to the first recess R. In other embodiments, the first and second recesses R may be differently configured in dependence upon the arrangement of the weakened lines of severance 129*a*, 129*b*. The second side panel 118 comprises an optional first arcuate fold line, which arcuate fold line is substantially "C" shaped (see FIG. 6). Each end of the arcuate fold line intersects or meets with the second weakened line of severance 129*b*. The second side panel 118 comprises an optional linear fold line spaced from the "C" shaped fold line. Each end of the linear fold line intersects, meets or terminates at the second weakened line of severance 129*b*.

The first and second recesses R in the fourth end closure panel 128 are arranged such that when the blank 110 is assembled to form a carton each recess R is in overlying relationship with a respective portion of the first weakened line of severance 129*a*. Preferably, the respective portions of the first weakened line of severance 129*a* overlaid by the recesses R at least include one of the ends of the first weakened line of severance 129*a* that terminate at the free end edge of the second end closure panel 124*a*. It is envisaged that each recess R is elongate in shape and is dimensioned such that it extends partially or fully across an overlapping region of the second and fourth end closure panels 124*a*, 128*a*. It will be understood that at each recess R, the number of plies of material has been reduced by one ply because of the presence of the recess R itself. The term "overlapping region" should nevertheless be interpreted to include the area where the second and fourth end closure panels 124*a*, 128*a* generally overlap, including the area where the recesses R are situated.

The blank 110 comprises an optional handle structure comprising a first handle aperture H1 struck from the first top panel 112*a* and a second handle aperture H2 struck form the second top panel 112*b*. The handle structure also comprises a first fold line 181*a* defined in the first top panel 112*a*. The first fold line 181*a* extends from the handle aperture H1, preferably from a corner thereof, to a corner of the first top panel 112*a* defined by the fold line 121*a* and the fold line 111. The handle structure also comprises a second fold line 181*b* defined in the first top panel 112*a* and extending from the handle aperture H1, preferably from a corner thereof, to a corner of the first top panel 112*a* defined by the fold line 121*b* and the fold line 111. The handle structure also comprises a third fold line 181*c* defined in the second top panel 112*b* and extending from the handle aperture H2, preferably from a corner thereof, to a corner of the second top panel 112*b* defined by the fold line 121*c* and the fold line 117. The handle structure also comprises a fourth fold line 181*d* defined in the second top panel 112*b*. The fourth fold line 181*d* extends from the handle aperture H2, preferably from a corner thereof, to a corner of the second top panel 112*b* defined by the fold line 121*d* and the fold line 117. The fold lines 181*a*, 181*b*, 181*c*, 181*d* are optional and in some embodiments may be omitted.

When the blank 110 is set-up into a carton the second and fourth end closure panels 124*a*, 128*a* are disposed in partially overlapping relationship and are secured together to close the ends of the tubular structure formed by the main panels 112*a*, 112*b*, 114, 116, 118. The recesses R are arranged to overlie the ends of the first weakened line of severance 129*a*. This has the benefit of reducing the number of layers of material a user must sever when removing the portion of the carton defined by the first and second weakened lines of severance 129*a*, 129*b* to create an access means to the carton's contents. It also increases the manufacturing tolerance for assembling the carton since it is no longer necessary to precisely align the first weakened line of severance 129*a* with the second weakened line of severance 129*b*.

Figure 7:
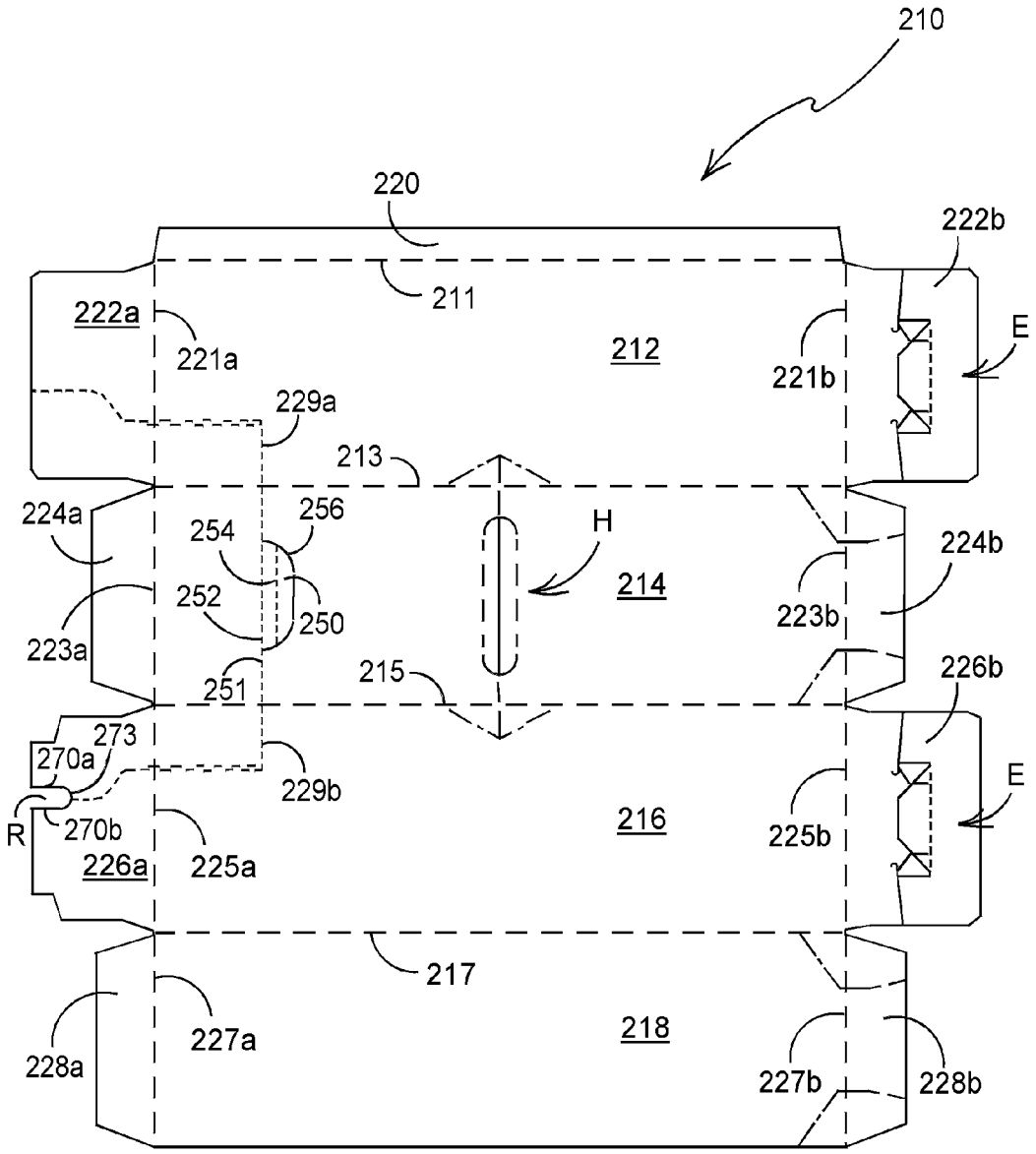
FIG. 7 is a plan view from above of a blank for forming a carton according to a third embodiment of the disclosure.

Turning now to FIG. 7 there is shown a blank 210 according to a third embodiment. The blank 210 comprises a plurality of main panels 212, 214, 216, 218 for forming; a first side panel 212, a top panel 214, a second side panel 216 and a bottom panel 218 in a set-up carton. A glue panel 220 is hinged to the first side panel 212 along a fold line 211. The bottom panel 212 is hinged to the top panel 214 by a fold line 213. The top panel 214 is hinged to the second side panel 216 by a fold line 215. The second side panel 216 is hinged to the bottom panel 218 by a fold line 217.

The plurality of main panels 212, 214, 216, 218 are foldable to form a tubular structure. Each of the ends of the tubular structure are at least partially closed by end closure panels 222*a*, 224*a*, 226*a*, 228*a*, 222*b*, 224*b*, 226*b*, 228*b*. End closure panels 222*a*, 224*a*, 226*a*, 228*a* are configured to close a first end of the tubular structure and end panels 222*b*, 224*b*, 226*b*, 228*b* are configured to close a second end of the tubular structure. A first end closure panel 222*a* is hinged to a first end of the first side panel 212 by a fold line 221*a*. A second end closure panel 224*a* is hinged to a first end of the top panel 214 by a fold line 223*a*. A third end closure panel 226*a* is hinged to a first end of the second side panel 216 by a fold line 225*a*. A fourth end closure panel 228*a* is hinged to a first end of the bottom panel 218 by a fold line 227*a*.

A fifth end closure panel 222*b* is hinged to a second end of the first side panel 212 by a fold line 221*b*. A sixth end closure panel 224*b* is hinged to a second end of the top panel 214 by a fold line 223*b*. A seventh end closure panel 226*b* is hinged to a second end of the second side panel 216 by a fold line 225*b*. An eighth end closure panel 228*b* is hinged to a second end of the bottom panel 218 by a fold line 227*b*.

Blank 210 comprises an end-pull device E defined in the fifth end closure panel 222*b* and eighth end closure panel 228*b*. The end-pull device E is substantially the same as that described above in respect of the first embodiment of FIG. 1; however the recesses R have been omitted. It will be appreciated that the fifth end closure panel 222*b* and the eighth end closure panel 228*b* need to be accurately aligned with the sixth end closure panel 224*b* and the seventh end closure panel 228*b* in order to ensure the weakened lines of severance are aligned.

The blank 210 comprises an optional carrying handle H for carrying the set-up carton.

The blank 210 comprises an access device for accessing the carton's contents. The access device comprises a first weakened line of severance 229*a* which extends across the first end closure panel 222*a* and into the first side panel 212. The first weakened line of severance 229*a* extends through the first side panel 212 to meet the fold line 213 between the first side panel 212 and the top panel 214.

The access device further comprises a second weakened line of severance 229*b* which extends across the third end closure panel 226*a* and into the second side panel 216. The second weakened line of severance 229*b* extends through the second side panel 216 to meet the fold line 215 between the second side panel 216 and the top panel 214. A recess or notch R, defined by side cuts 270*a*, 270*b* and a termination 273, interrupts a free end edge of the third end closure panel 226*a*. The recess R is formed substantially similarly to the first and second recesses R of the second embodiment. The second weakened line of severance 229*b* intersects, meets or terminates on the closed end 273 of the recess R. The access device comprises a third weakened line of severance 251 which extends transversely across the top panel 214. The third weakened line of severance 251 is arranged to be contiguous with the first and second weakened lines of severance 229*a*, 229*b*. In a set-up carton the first, second and third weakened lines of severance 229*a*, 229*b*, 251 form a continuous or contiguous loop which defines a removable corner portion of the carton (not shown). The access means comprises an optional finger engagement or tear initiation means. The tear initiation means comprises a tab 250 defined in part by a fold line 252. Fold line 252 interrupts the third weakened line of severance 251 so as to be contiguous therewith. The tab 250 is defined in part by a cut line or fourth weakened line of severance 256. Fourth weakened line of severance 256 comprises a first end and a second end, each of which is adjacent to or contiguous with a respective one of the ends of the fold line 252. A further optional fold line 254 is provided across the tab 250 and which extends transversely with respect to a tubular axis of the set-up carton.

When the blank 210 is set-up into a carton the first and third end closure panels 222*a*, 226*a* are disposed in partially overlapping relationship and are secured together to close the ends of the tubular structure formed by the main panels 212, 214, 216, 218. The recess R is arranged to overlie the end of the first weakened line of severance 229*a*. This has the benefit of reducing the number of layers of material a user must sever when removing the corner portion of the carton defined by the first, second and third weakened lines of severance 229*a*, 229*b*, 251 to create an access means to the carton's contents. It also increases the manufacturing tolerance for assembling the carton since it is no longer necessary to precisely align the first weakened line of severance 229*a* with the second weakened line of severance 229*b*.

It is envisaged that each recess or notch R is elongate in shape and that is dimensioned such that it extends across a region of the third end closure panel 226*a* in overlapping relationship with the first end closure panels 222*a*. Optionally, by elongate it is meant of greater length than width. In other words the length of sides 270*a*, 270*b* is greater than the distance between the sides 270*a*, 270*b*.

Figure 8:
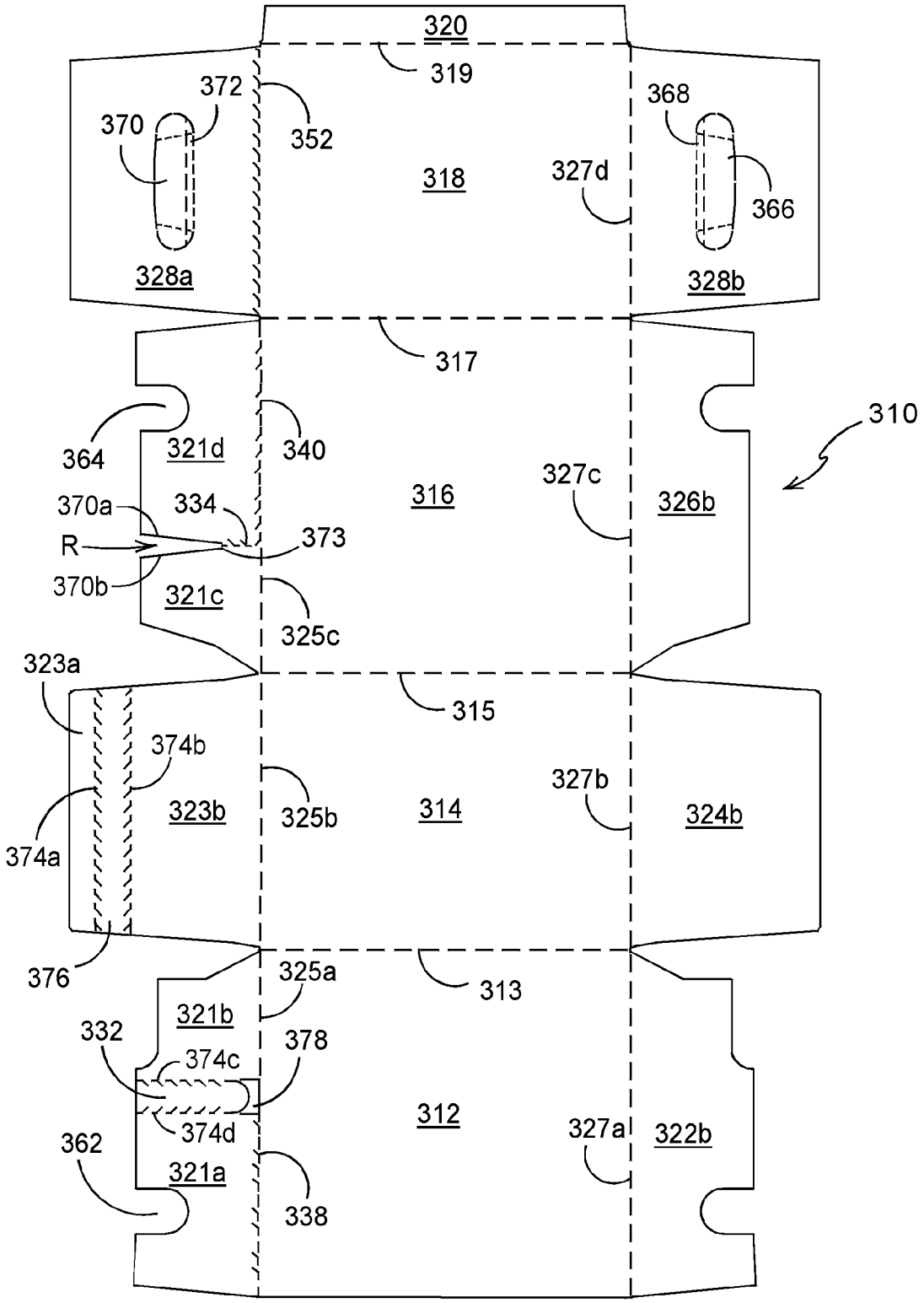
FIG. 8 is a plan view of a blank for forming a carton illustrating a further application of another embodiment of a tear mechanism of the disclosure.

Referring to FIG. 8, there is shown a further blank 310 that is formed from a sheet of suitable substrate, in this example, paperboard.

In the exemplary embodiment, the blank 310 is configured to form a carton 330 (see FIG. 10) for packaging an exemplary arrangement of exemplary articles. For example, the arrangement is a 3×4 matrix and the articles are optionally glass bottles A. The blank 310 may alternatively be configured to form a carton for packaging other articles and/or different arrangements of articles.

The blank 310 comprises a hinged series of main panels 318, 316, 314, 312 for forming the main body of a tubular carton 330, optionally of the end loading, fully enclosed type. The hinged series of main panels includes a top panel 318, a first side panel 316, a bottom panel 314 and a second side panel 312 interconnected by crease or fold lines 317, 315 and 313 respectively.

Each end of the series of main panels 318, 316, 314, 312 is provided with an end closure flap 328*a*, 328*b*, 321*c*/321*d*, 326*b*, 323*b*, 324*b*, 321*b*/321*a*, 322*b*.

Together the end closure flaps 328*a*, 328*b*, 321*c*/321*d*, 326*b*, 321*b*/321*a*, 322*b*, 323*b*, 324*b*, at each end of the main body panels 318, 316, 314, 312 are folded and secured together to form end walls 328*b*/326*b*/324*b*/322*b*; 328*a*/326*a*/324*a*/322*a* similarly to those described above.

A glue panel 320 is hinged, optionally, to the top panel 318 along fold line 319 and is provided for affixing the top panel 318 to the second side panel 312. The blank 310 is folded and assembled into a carton 330 in a typical manner.

Optionally, handle apertures (denoted generally by 370, 366) are provided for assisting with the lifting and carrying of the carton package 330 formed from the blank 310.

An access structure, (also referred to as access means, dispenser or detachable portion) comprises a series of frangible sections (also referred to as perforable sections): 328*a*, 321*d*, 323*a*, 321*a*, 376, 332; an initiating section 332; and an initiating section notch 378. The frangible sections 328*a*, 321*d*, 323*a*, 321*a*, 376, 332 are defined by a series of frangible lines (also referred to as perforable lines): 352, 340, 334, 374*a*, 374*b*, 374*c*, 374*d* and 338. Optionally, the access structure is provided at only one end of the carton 330. In other envisaged embodiments, an access structure may be provided only at the other end of the carton 330, or optionally at both ends of the carton 330. When the carton 330 is assembled the end closure flap 321*d* and end closure flap 323*d* are at least partially overlapping. In an overlapping region of these panels 321*d*, 323*d*, a recess R is provided. The recess R is formed as a substantially "V"-shaped cut defined by convergent, non-parallel side cuts 370*a*, 370*b* and a blunt termination 373. The frangible line 334, that in part defines the frangible section 321*d*, terminates at the straight or blunt termination 373 of the recess R. Alternatively, the termination 373 of the recess may be pointed or curved.

Figure 9:
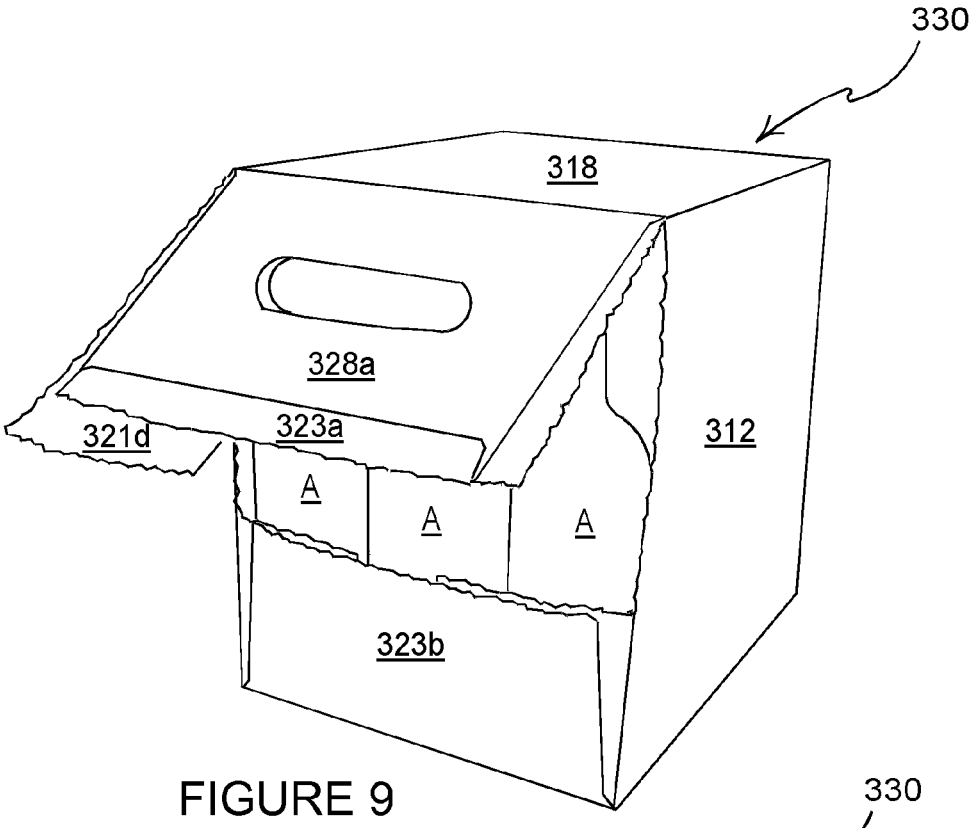
FIG. 9 is a perspective view from the top, end and side of a carton formed from the blank of FIG. 8, wherein during detachment of a detachable access structure the tear mechanism has been utilised.

An outer view of the composite end wall 328*a*/323*b*/321*d*/321*c*/321*a*/321*b* having the access structure 328*a*/321*d*/323*a*/321*a*/332/376 can be seen in FIG. 9.

Figure 10:
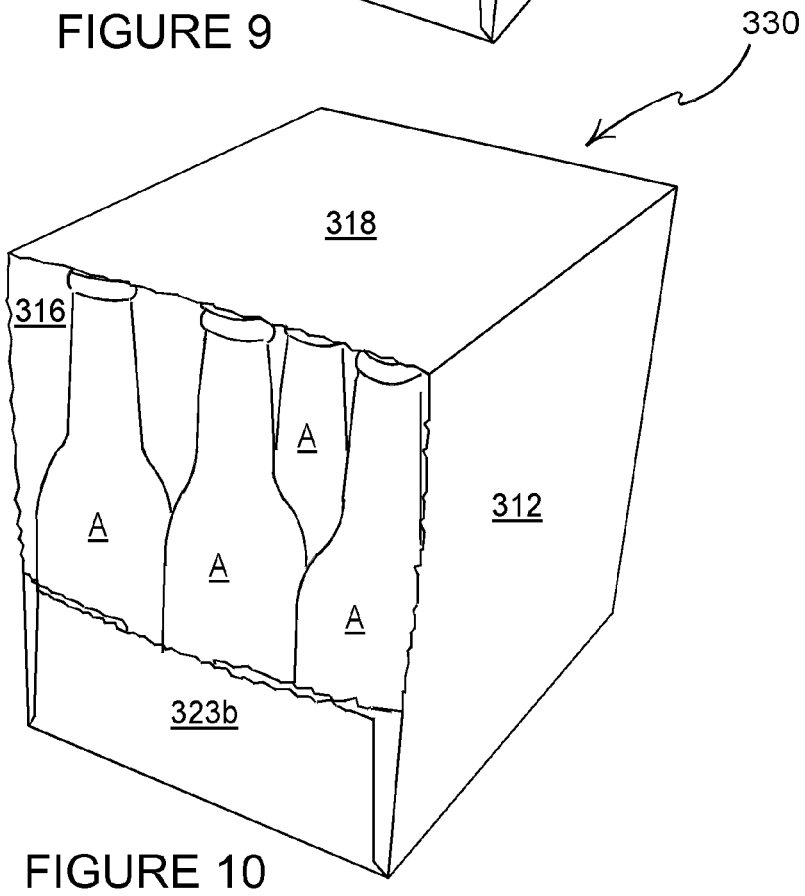
FIG. 10 is a perspective view from the end, side and top of the carton of FIGS. 8 and 9 wherein detachment of the detachable access structure has been completed, exposing a front most row of articles for individual removal from the carton/package.

The top end closure panel 328*a* provides a first frangible section of the access structure which may be completely removed from the carton 330 when the access structure is detached, to provide a full-carton-width opening of at least approximately half-carton-depth (see FIG. 10). Preferably, the top end closure panel 328*a* is affixed, (optionally by hot-melt adhesive, but other suitable affixing means may be used), to an upper portion 323*a* of the bottom end closure flap 323*b*; to an upper portion 321*d* of the first side end closure flap 321*c*/321*d*; and to an upper portion 321*a* of the second side end closure flap 321*a*/321*b*. The top end closure flap 328*a* may optionally have tapered side edges and, apart from the frangible hinge connection 352 with the top panel 318, is otherwise not connected to part of the carton 330 body that is not also part of the access structure. The top end closure panel 328*a* may serve to connect together each other frangible section 321*d*, 323*a*, 321*a* of the access structure.

Frangible lines 340, 334 are disposed in the minor end closure flap 321*c*/321*d* and are configured to separate the end closure flap 321*c*/321*d* into two sections: 321*d* which is removed with the access structure; and 321*c* which remains attached to the carton 330 (via the hinge connection 325*c* with the first side panel 316). The recess R described above facilitates the separation of the end closure flap 321*c*/321*d* into separate sections.

Frangible lines 374*a*, 374*b* disposed in the major end closure flap 323*b* form a perforable tear strip 376. At one end of the tear strip 376 an initiator section may be provided to assist a user in grasping the tear strip 376. Optionally an underlying minor flap 321*a* additionally comprises a portion of tear strip 332 defined by frangible or perforable lines 374*c*, 374*d*, along with an initiator section 378. The further frangible line 338 disposed in the minor end closure flap 321*a*/321*d* is configured to separate the minor end closure flap 321*a*/321*b* into two sections: 321*a* which is removed with the access structure; and 321*b* which remains attached to the carton 330 (via the hinge connection 325*a* with the second side panel 312).

The initiator section 378 is provided for starting the detachment of the detachable access structure. Optionally the initiator section 378 comprises an aperture formed in the minor end flap 321*a*/321*b*. However, in other envisaged embodiments, the initiator section 378 may be formed in the major bottom end flap 323*a*/323*b*. In other envisaged embodiments, the initiator section 378 may comprise a push tab which may be defined at least in part by a frangible line or weakened line or fold line. Such a push tab may provide a weakened area which may more easily be broken away from the remainder of the minor end flap 321*a*/321*b* (or in yet further envisaged embodiments broken away from the major bottom end flap 323*b*). A user can exploit the initiator section aperture 378 to achieve a sufficiently strong grasp of the composite tear strip 376/332 for pulling on the composite tear strip 376/332 to propagate a tear or break along the frangible lines 374*a*, 374*b*, 374*c*, 374*d* (see FIG. 9).

The provision of the recess or notch R facilitates the simultaneous breaking of frangible line 334 and the overlaying frangible line 374*b*. In this way, the overlapping end closure panels 321*d*, 323*b* can more easily be separated. Optionally, due to the provision of the initiating section 332 and initiating section notch 378, a recess R is not provided in the opposite end closure panel 321*a*/321*b*.

After or during detachment of the tear strip 376/332, the remainder of the detachable access structure can be separated from the carton 330. After or during detachment of the tear strip 376/332 the frangible line 334 may be broken such that both minor flaps 321*a*/321*b*, 321*c*/321*d* are separated into their two parts. A user may then pull the remaining detachable section upwardly to break the connections 340, 338 that are disposed co-incidentally with the hinge connections with the adjacent first and second side walls 316, 312 (see FIGS. 9 and 10). Then the detachable access structure can be completely separated from the remainder of the carton 330 by propagating a tear or break along the frangible connection 352 formed co-incidentally with the vertex or corner between the top end closure flap 328*a* and the top panel 318. As such no portion, or at least no substantial portion of any of the top panel 318, first side panel 316 or second side panel 312, is removed from the carton 330. Only a portion of a composite end wall structure is removed. The carton body 330 thereby retains its structural integrity and can be used to hold and retain the articles A contained therein. The remaining portion 323*b*/321*c*/321*b* of the composite end wall forms a stopper wall of sufficiently high height to resist unintentional egress of any articles and yet of sufficiently low height to enable a consumer to easily remove an article through the opening provided.

Beneficially, the body of the carton retains its structural integrity after detachment of the access structure. This is advantageous where the carton 330 may be stored in a humid environment, such as a refrigerator (humidity can weaken the paperboard substrate) and/or where the carton 330 contains heavy articles (such as 12 oz/330 ml glass bottles). Furthermore, it is desirable for a consumer to be able to place the carton 330 in a refrigerator where storage and shelf height restrictions may make access via the top of the carton more difficult. Therefore, by providing an opening (optionally disposed in the lowest width end, rather than in the wider side) in the end wall that will be disposed at the front when the carton 330 is placed on a refrigerator shelf, the need to withdraw articles through the top panel of the carton and, therefore, the need for height above the carton 330 within the refrigerator is alleviated. The relative orientation of the articles and carton bottom, top and end walls may be more of a consideration where the articles are tapered, such as bottles A, and for stability reasons as well as for the protection of frangible articles (where the bottles are glass) it is desirable to keep the carton 330 oriented such that its bottom panel 314 upon which the bases of the articles A are in contact, remains bottommost.

Figure 11:
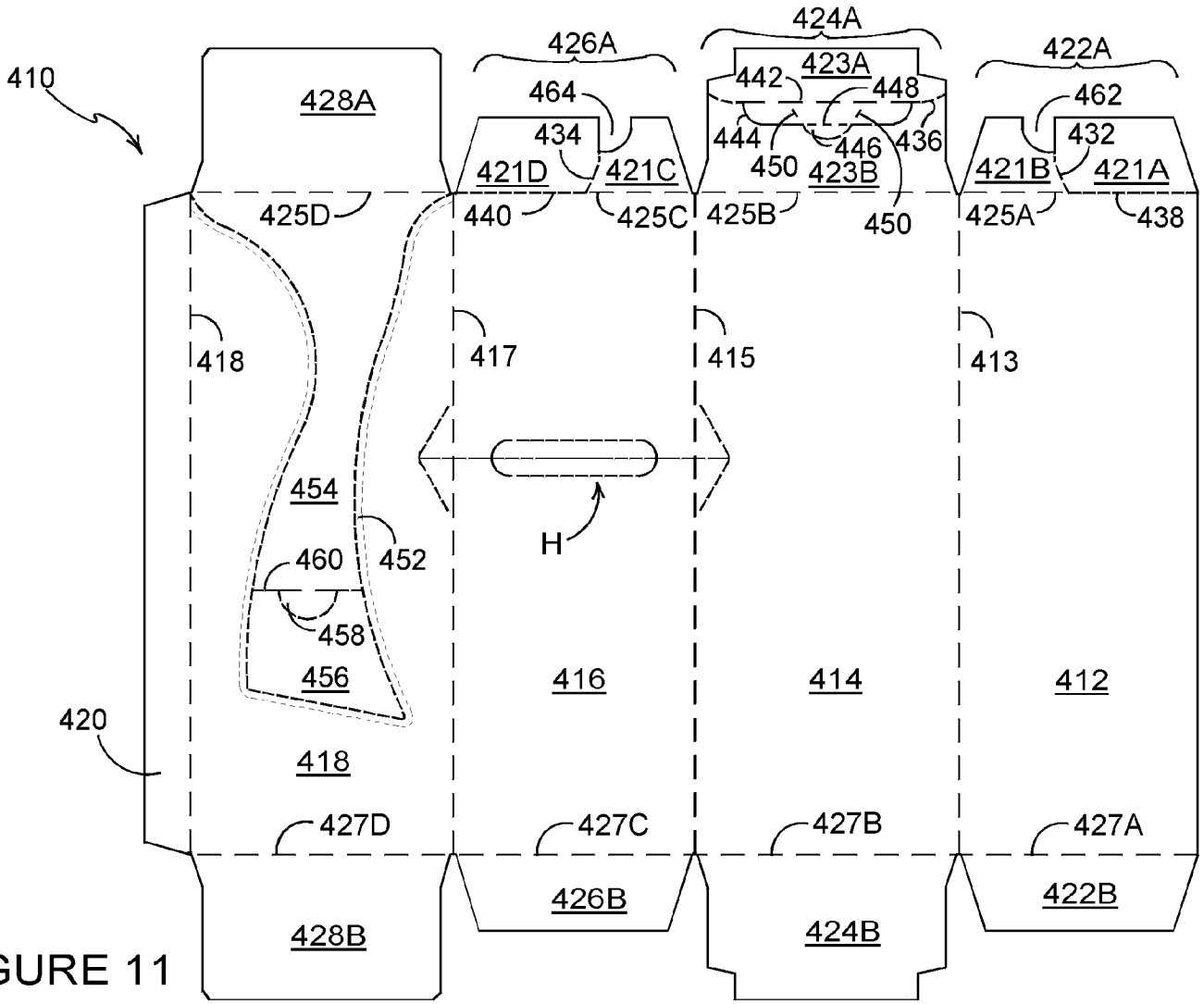
FIG. 11 is a plan view of a blank for forming a carton illustrating yet a further application of another embodiment of a tear mechanism of the disclosure.
Figure 12:
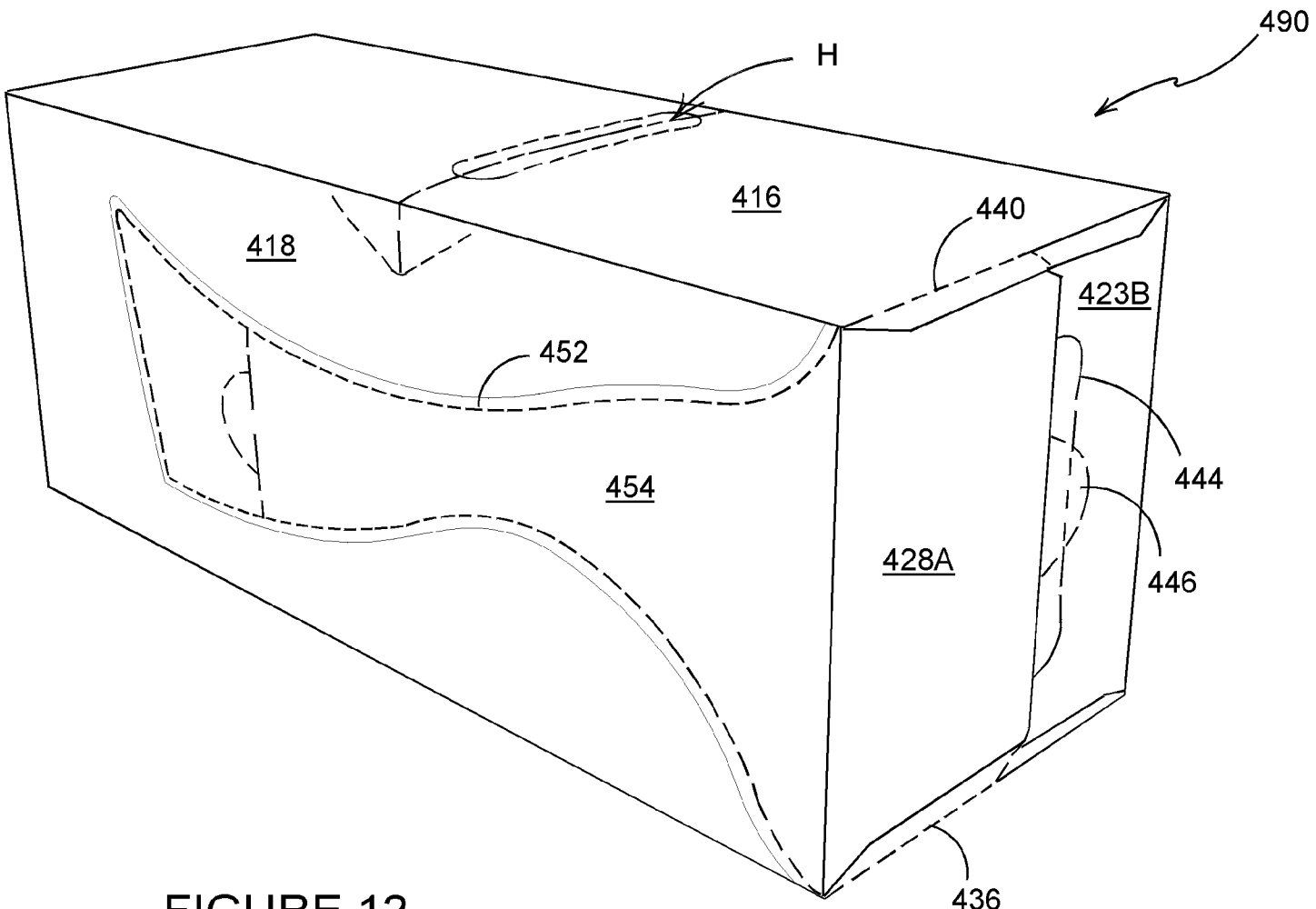
FIG. 12 is a perspective view from the top, end and side of a carton or package formed from the blank of FIG. 11.

Referring to FIG. 11 there is shown another blank 410 optionally formed of foldable sheet material, for example paperboard for forming another fully enclosed end-loading style carton 490 (see FIG. 12) having an access structure.

The access structure is depicted in FIGS. 11 to 15. The access structure (also referred to as access means, dispenser or detachable portion) is defined by a series of frangible lines or frangible sections: 452, 440, 434, 436, 444, 432, 438; an initiating section 423A and recesses 464, 462 or recesses 464, 462.

A first frangible line 452 is disposed in the first side panel 418 and defines therein a removable section 454, 456 of the first side panel 418. Further frangible lines 440, 434 are disposed in the minor end closure flap 426A and are configured to separate the minor end closure flap 426A into two sections: 421D which is removed with the access structure; and 421C which remains attached to the carton 490 (via the hinge connection 425C with the top panel 416). A recess or notch 464 is formed by an arched cut out in the minor end flap 426A. The arched cut out is defined by a straight side cut and an arcuate side cut which provides a curved termination of the recess or notch 464. Additional frangible lines 444, 436 are disposed in the major end closure flap 424A along with the initiator section 423A. Further frangible lines 438, 432 are disposed in the minor end closure flap 422A and are configured to separate the minor end closure flap 422A into two sections: 421A which is removed with the access structure; and 421B which remains attached to the carton 490 (via the hinge connection 425A with the bottom panel 412). A recess 464 is formed by an arched cut out in the minor end flap 422A. The arched cut out is defined by a straight side cut and an arcuate side cut which provides a curved termination of the recess 462.

The initiator section 423A optionally comprises a push tab 446 which may be defined at least in part by an arcuate frangible line 450 and in part by a frangible or weakened line or fold line 448. The push tab 446 may provide a weakened area which may more easily be broken away from the remainder of the major end flap 424A for starting the detachment of the detachable access structure. Fold line 448 may assist in the inward folding of a leading part of push tab 446 to create an opening in the carton 490 which a user can exploit to achieve a stronger grasp of the remainder of the initiator section 423A. The linear portion of the initiator section 423A between fold line 442 and frangible or cut line 444 may then readily follow the leading edge push tab 446 into the carton for folding about fold line 442 over the remaining part of the initiator section 423A defined by frangible line 436 and the cut edge of the major end flap 424A.

The carton 490 is constructed as before. The minor end flaps 422A, 426A are disposed beneath the major end flap 424A such that in an overlapping region, the fold line 442 is aligned with the recesses 462, 464. Whereas the fold line 442 is intended to serve as a crease, in some arrangements the fold line 442 may be formed such that it is frangible. The recesses 462, 464 enable the fold line 442 to break or fold more easily.

From the outside of the carton 490, part of the access structure can be seen: the detachable portions 454, 456 denoted by frangible line 452 in the top panel 418; major end flap 428A and portions 421D, 421A of the underlying minor end flaps 426A, 422A defined by fold lines 440, 434, 438, 432; and part of the initiating section 423A formed in the major end flap 424A.

From inside the carton 490 (see FIG. 14) a different aspect of the access structure can be seen, albeit wherein the access structure is starting to be used. Nevertheless, it will be understood from FIG. 14 and FIG. 11 that when the carton 490 is constructed, the access structure further comprises the initiator section 423A that is contiguously formed with the removable sections 421A, 421D of the minor end flaps 422A, 426A and aligned with the recesses 464, 462.

Figure 13:
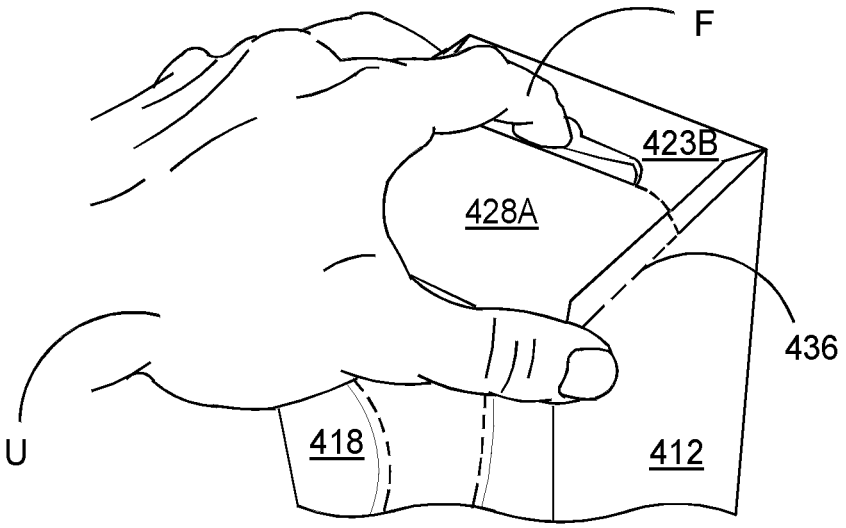
FIG. 13 is a partial perspective view of the carton of FIG. 12 showing a user initiating the opening of the carton using an access structure provided on the carton.

The initiator section 423A and the recesses or notches 464, 462 co-operate so that a user can press or push inwardly the initiator section 423A, breaking the frangible lines 444, 436 to press a leading part 446 of the initiator section 423A into the carton 490 (see FIG. 13). The leading part 446 of the initiator section 423A is then foldable about a fold line 442 (see FIG. 11) and due to the complementary shaping and co-operative structures of the leading part of the initiator section 423A and the minor end flaps 426A, 422A (in particular the size and position of the recesses 464, 462), the leading part of the initiator section 423A is foldable at least substantially into overlapping face-contacting relationship with the inside surfaces of a part of minor end flaps 421A, a part of minor end flap 421D and a part of major end flap 428A.

Figure 14:
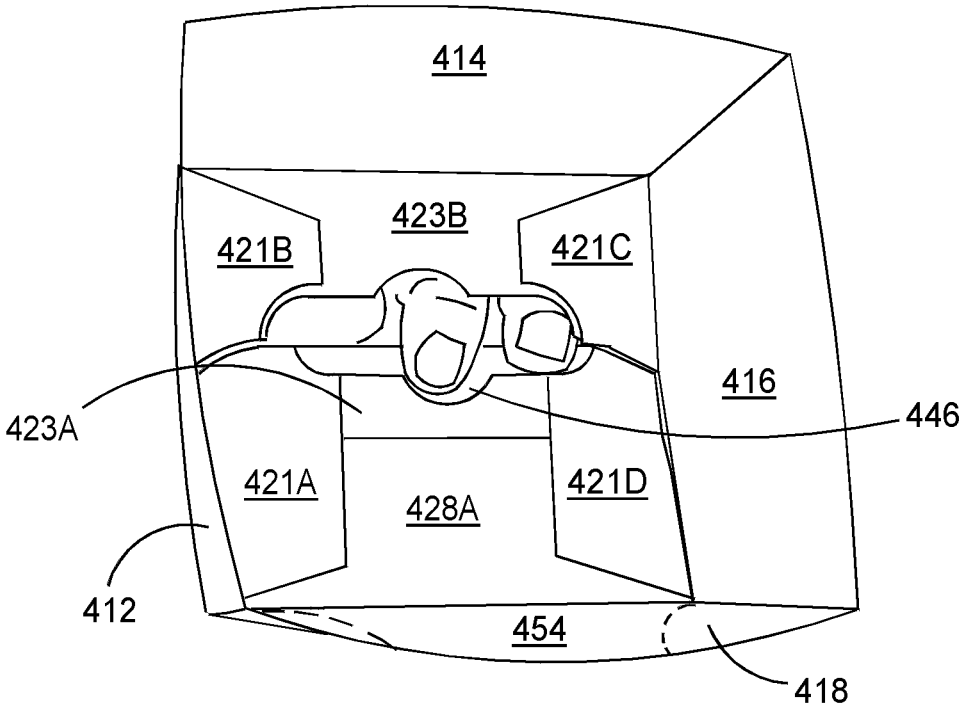
FIG. 14 is a partial perspective view from inside the carton of FIG. 12 illustrating the user's fingers having initiated the opening of the carton and grasping part of the end wall in which the access structure is provided.
Figure 15:
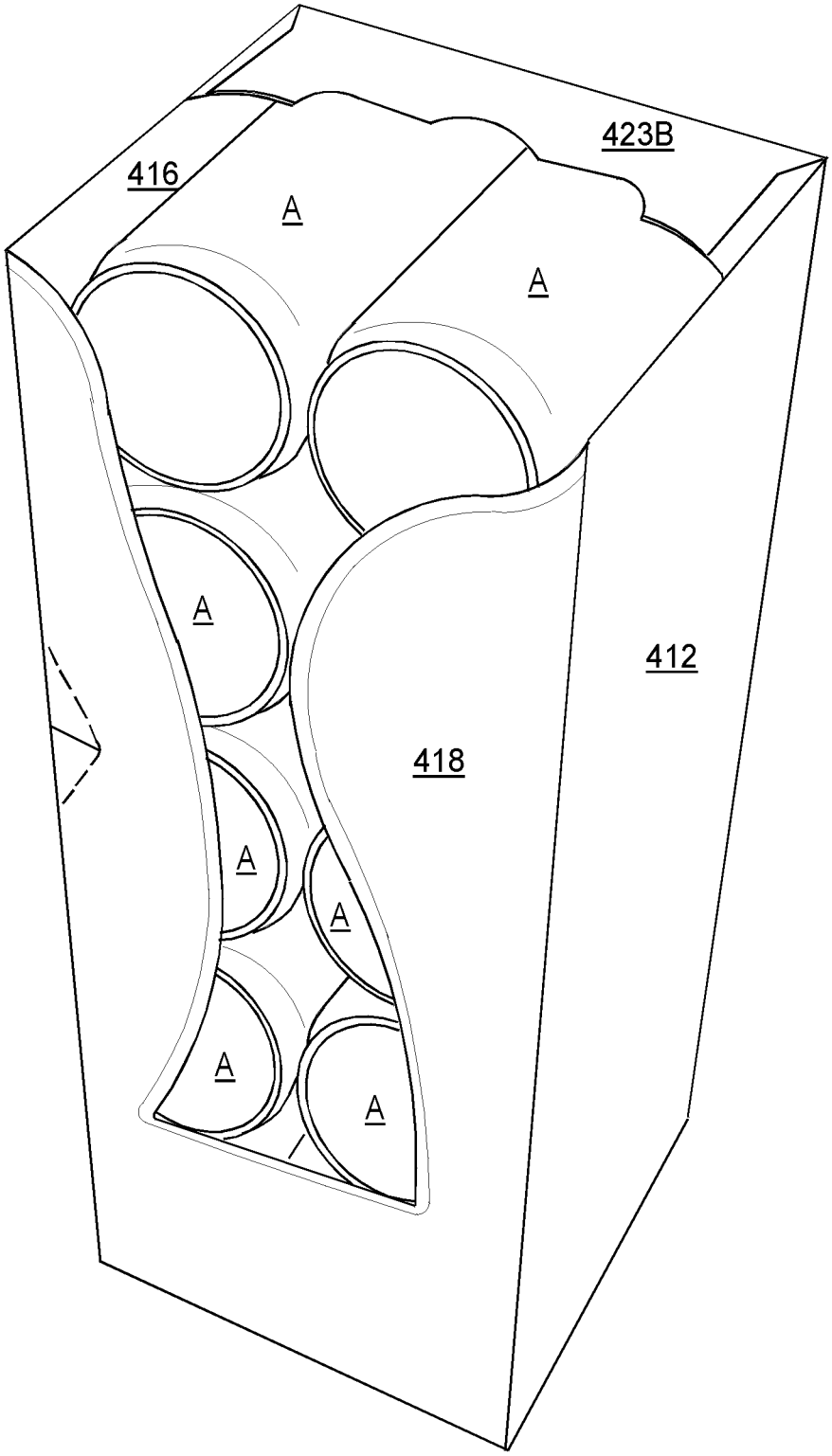
FIG. 15 is a perspective view from the end, side and top of the carton of FIG. 12 wherein the access structure has been fully deployed and a detachable section of the end and side walls has been removed exposing at least one article for removal.

The leading part of the initiator section 423A is shaped such that when folded over (as afore described and as illustrated in FIG. 14), the leading part overlaps and provides a useful and effective means of grasping sections 421A, 421D and 428A of the access structure that may not be directly attached to one another. In other words, the overlapped nature, size and shape of the folded over portion of the initiator portion 423A assists the effective and clean detachment of portions 421A, 421D, 428A and 423A from the carton 490 by breaking the frangible lines 434, 432, 438, 440 and 452. It can be seen in FIG. 15 that once all detachable parts of the access structure are fully removed that endmost of the articles A are sufficiently exposed for their withdrawal, whilst at the same time being sufficiently retained to mitigate against the inadvertent or unintentional egress of one or more articles from the opened carton 490.

Whereas the access structure has been described as being formed in the first side panel 418 and composite end wall it will be understood that, alternatively or additionally, the access structure could be formed at least in part, in the second side panel 414.

Figure 16A:
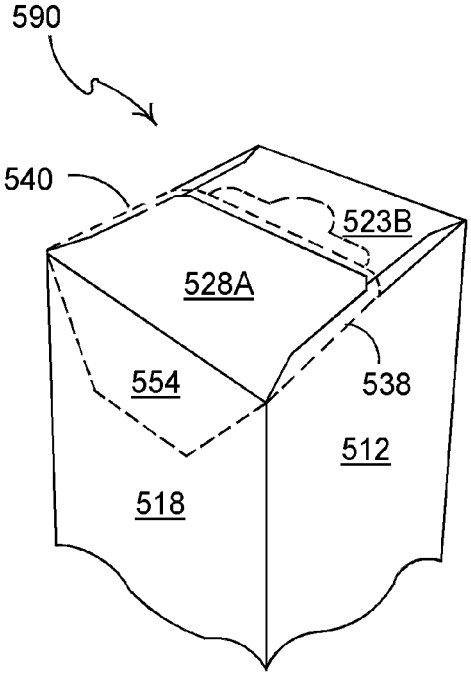
FIGS. 16A and 16B are partial perspective views from the end, side and top of a carton according to a further embodiment of the disclosure showing the formation of the composite end wall and the construction of an access structure formed therein.
Figure 16B:
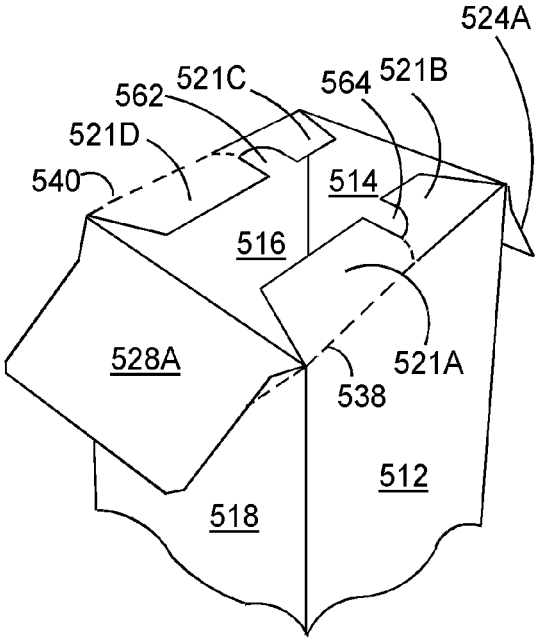

In FIGS. 16A and 16B, another embodiment of the access structure comprises a smaller and squarer shaped detachable portion 554 formed in the first side panel 518. Further, the initiating section formed in panel 523B may not comprise frangible lines 450 and 448 comprised in the first illustrated embodiment, but may comprise a non-interrupted portion hinged to the major end flap 524A along fold line 548. The initiator section may still be pressed inwardly of the carton 590 to initiate removal of the detachable access structure. The initiator section comprises a series of curved edges (once broken out) and in complimentary manner, the minor end closure tabs are shaped, optionally with a recess or notch 562, 564 to provide a clearance space for the initiator section to fold through and/or to facilitate breaking of a fold line of the initiator section. Additionally, the minor end flaps are shaped such that after the initiator section has been folded through the gap provided by the recesses or notches 562, 564 the initiator section can be folded over into contacting relationship with detachable portions 521A, 521D of the minor flaps to assist the detachment of those portions 521A, 521D by the breaking of the frangible lines 540, 538 that are aligned with the connection between the minor end flaps and the adjacent main panels 512, 516.

Figure 17A:
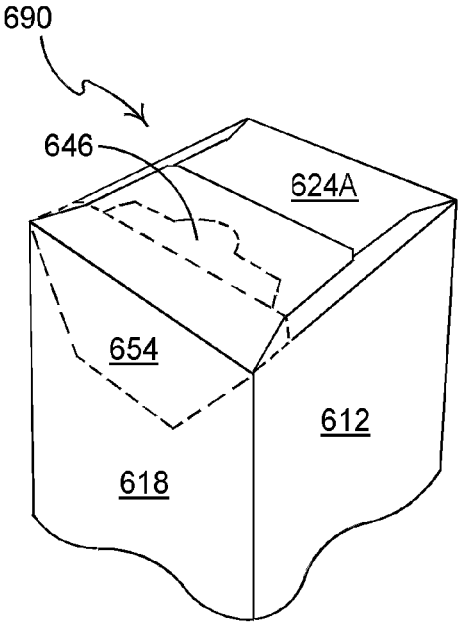
FIGS. 17A and 17B are partial perspective views from the end, side and top of a carton according to an even further third embodiment, showing the formation of the composite end wall and the construction of an access structure formed therein.
Figure 17B:
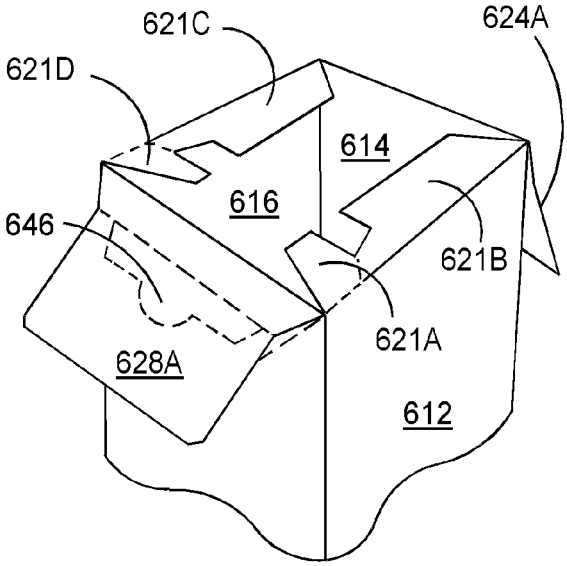

In a final illustrated embodiment in FIGS. 17A and 17B, an access structure again comprises a smaller and squarer shaped detachable portion 654 formed in the first side panel 618. Further, the initiating section formed in panel 623B is closer to the first side panel 616 and does not comprise frangible lines 450 and 448 comprised in the first illustrated embodiment. The initiator section 646 may still be pressed inwardly of the carton 690 to initiate removal of the detachable access structure. The initiator section comprises a series of squarer edges (once broken out) and in complimentary manner, the minor end closure tabs are shaped, optionally with a recess or notch 662, 664 to provide a clearance space for the initiator section to fold through and/or to break through. Additionally, the minor end flaps are shaped such that after the initiator section has been folded through the gap provided by the recesses or notches 662, 664 the initiator section can be folded over into contacting relationship with detachable portions 621A, 621D of the minor flaps to assist the detachment of those portions 621A, 621D by the breaking of the frangible lines that are aligned with the connection between the minor end flaps and the adjacent main panels 612, 616.

It can be appreciated that various changes may be made within the scope of the present invention. For example, the size and shape of the panels and apertures may be adjusted to accommodate articles of differing size or shape. In particular, it is envisaged that the recess or notch R may be employed in a variety of carton styles including, but not limited to: fully enclosed cartons, wrap around cartons, basket carrier style cartons, top gripping cartons and the like. The present invention may be employed with two or more at least partially overlapping panels in which it is desired to provide a continuous line of severance across the overlap between the two or more panels.

It will be appreciated that in the foregoing embodiments the recess R or notch may be disposed in registration or alignment with a cut line as an alternative to a weakened line of severance.

Whereas, in the foregoing embodiments the carton panel comprising the recess R is disposed externally (outermost) and the carton panel comprising the weakened line of severance is disposed internally (innermost), it will be appreciated that in alternative embodiments the recess may be disposed internally of the carton panel having the weakened line of severance.

It will be recognised that as used herein, directional references such as "top", "bottom", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to "hinged connection" or "fold line" should not be construed as necessarily referring to a single fold line only; indeed it is envisaged that a hinged connection can be formed from any one or more of the following, a short slit, a frangible line or a fold line without departing from the scope of the invention.

As used herein, the term "weakened lines of severance" refers to all manner of lines formed in a substrate of sheet material, that facilitate separating portions of the substrate from one another or that indicate optimal separation locations on the substrate. A "weakened line of severance" may be a frangible or otherwise weakened line, that is formed of one or more elements which include, but not limited to, a single cut, a single half-cut, a single slit, an interrupted cut, a score line, an interrupted score line, a perforation or line of perforations, a line of short slits, a line of short half cuts, a combination of slits and score lines, and any combination of the aforementioned options. In some embodiments the weakened line may be formed by a cut line only such that the substrate is severed.

It should be understood that the term "hinged connection" and the term "fold line" as use herein can each include one or more elements that are formed in the substrate of the blank including, but not limited to, a perforation, a line of perforations, a line of short slits, a line of half-cuts, a single half-cut, a cut line, an interrupted cut line, slits, scores, any combination thereof, and the like.

The one or more elements of a weakened line of severance, hinged connection or fold line can be dimensioned and arranged to provide the desired functionality. For example, a perforation or line of perforations can be dimensioned or designed with degrees of weakness to define a fold line and/or a weakened line of severance. The line of perforations can be designed to facilitate folding and resist breaking, to facilitate folding and facilitate breaking with more effort, or to facilitate breaking with little effort.

The phrase "in registry with" as used herein refers to alignment of two or more elements in a erected carton, such as two weakened lines of severance formed respectively in two overlapping panels or one weakened line of severance and one elongated recess or notch formed respectively in two overlapping panels. Those elements in registry with each other may be aligned with each other in the direction of the thickness of the overlapping panels. For example, when an elongated recess in a first panel is "in registry with" a weakened line of severance in a second panel that is placed in an overlapping arrangement with the first panel, the weakened line of severance may extend along the elongated recess and may be aligned, in the direction of the thickness of the first and second panels, with the recess.

The invention claimed is:

1. A carton for packaging one or more articles, the carton comprising a first panel and a second panel, the first panel being disposed in at least partially overlapping relationship with the second panel to define an overlapping region, the carton comprising a weakened line of severance which extends from the first panel across the overlapping region and into the second panel in a contiguous manner, wherein the first panel comprises a recess or notch defined at least in part in the overlapping region, the recess extending fully across a portion of the first panel which is within the overlapping region, the recess being arranged in registry with at least a portion of the weakened line of severance in the second panel.

2. A carton according to claim 1 wherein the weakened line of severance defined in the first panel intersects the recess or terminates at the recess.

3. A carton according to claim 1 wherein the weakened line of severance defines part of a handle structure.

4. A carton according to claim 1 wherein the weakened line of severance defines part of an access device for removing an article from the carton.

5. A carton according to claim 1 wherein the recess is aligned, in the direction of the thickness of the first and second panels, with the at least a portion of the weakened line of severance in the second panel.

6. A carton according to claim 1 wherein the at least a portion of the weakened line of severance in the second panel is located within the overlapping region.

7. A carton according to claim 1, further comprising a plurality of walls for forming a tubular structure, wherein the first panel is hinged to a first one of the plurality of walls, wherein the second panel is hinged to a second one of the plurality of walls, and wherein the first one of the plurality of walls is disposed at a position opposing the second one of the plurality of walls.

8. A carton for packaging one or more articles, the carton comprising a plurality of walls including a top wall, a first side wall, a second side wall, a first end wall, a second end wall and a bottom wall, one of the plurality of walls comprising a first panel and a second panel, the first panel being disposed in at least partially overlapping relationship with the second panel to define an overlapping region, the one of the plurality of walls further comprising a weakened line of severance which extends from the first panel across the overlapping region and into the second panel in a contiguous manner, wherein the first panel comprises a recess or notch defined at least in part in the overlapping region, the recess or notch extending fully across a portion of the first panel which is in the overlapping region, the recess or notch being arranged in registry with at least a portion of the weakened line of severance in the second panel.

9. A carton according to claim 8 wherein the top wall, first side wall, second side wall and bottom wall form a tubular structure having opposed ends which are at least partially closed by the first and second end walls respectively, the one of the plurality of walls comprising the first end wall, the first end wall comprising a first end closure panel and a second end closure panel, the first and second end closure panels comprise the first and second panels respectively, the recess or notch is struck from the first end closure panel of the first end wall and overlies the at least a portion of the weakened line of severance in the second end closure panel of the first end wall.

10. A carton according to claim 9 wherein the recess or notch extends from a free end edge of the first end closure panel, and the portion of the first end closure panel that the recess or notch extends across has a width that is less than a half of the width of the first end closure panel, wherein the width of the first end closure panel is defined as the distance between its free end edge and a hinged connection between the first end closure panel and an adjacent one of said plurality of walls.

11. A carton according to claim 9 wherein the first end closure panel further comprises a second recess, the recess or notch extending from a first free end edge of the first end closure panel and the second recess extending from a second free end edge of the first end closure panel wherein the first free edge is positioned opposite to the second free end edge.

12. A carton according to claim 8 wherein the recess or notch is aligned, in the direction of the thickness of the first and second panels, with the at least a portion of the weakened line of severance in the second panel.

13. A carton according to claim 8 wherein the at least a portion of the weakened line of severance in the second panel is located within the overlapping region.

14. A carton according to claim 8 wherein the carton has a handle structure defined in part in the first panel of the one of the plurality of walls and in part in the second panel of the one of the plurality of walls, and wherein the weakened line of severance defines at least part of the handle structure.

15. A carton according to claim 8 wherein the carton has a removable portion for accessing said one or more articles, the removable portion being defined in part in the first panel and in part in the second panel, the removable portion comprising the weakened line of severance.

16. A carton according to claim 15 wherein the one of the plurality of walls comprising the first end wall, and wherein the weakened line of severance extends from the first panel into the first side wall, the weakened line of severance extends from the first side panel into the top wall, the weakened line of severance extends from the top wall into the second side wall and from the second side wall into the second panel.

17. A blank for forming a carton, the blank comprising a first panel and a second panel, the first panel being arranged so as to be disposable in at least partially overlapping relationship with the second panel in a set-up carton to define an overlapping region, the carton comprising a weakened line of severance defined in the first panel and the second panel, the weakened line of severance configured to be contiguous in a set-up carton such that the weakened line of severance extends from the first panel across the overlapping region and into the second panel in a contiguous manner, wherein the first panel comprises a recess or notch defined at least in part in the overlapping region, the recess or notch extending fully across a portion of the first panel in the overlapping region and wherein the recess or notch is arranged in registry with at least a portion of the weakened line of severance in the second panel.

18. A blank according to claim 17 wherein the recess or notch, when the blank is set up into a carton, is aligned, in the direction of the thickness of the first and second panels, with the at least a portion of the weakened line of severance in the second panel.

19. A blank according to claim 17 wherein the at least a portion of the weakened line of severance in the second panel is located within the overlapping region when the blank is set up into a carton.

* * * * *